US009242778B2

(12) United States Patent
Hanten et al.

(10) Patent No.: US 9,242,778 B2
(45) Date of Patent: Jan. 26, 2016

(54) PACKAGING COMBINATION

(75) Inventors: Jürgen Hanten, Bad Nauheim (DE); Frank Niedecker, Porza (CH)

(73) Assignee: Poly-clip System GmbH & Co. KG, Hattersheim (DE)

( * ) Notice: Subject to any disclaimer, the term of this patent is extended or adjusted under 35 U.S.C. 154(b) by 186 days.

(21) Appl. No.: 14/116,975

(22) PCT Filed: May 11, 2012

(86) PCT No.: PCT/EP2012/058790
§ 371 (c)(1),
(2), (4) Date: Jan. 9, 2014

(87) PCT Pub. No.: WO2012/152927
PCT Pub. Date: Nov. 15, 2012

(65) Prior Publication Data

US 2014/0110432 A1 Apr. 24, 2014

(30) Foreign Application Priority Data

May 11, 2011 (EP) ..... 11003880
Aug. 10, 2011 (EP) ..... 11006613
Jan. 27, 2012 (EP) ..... 12000555

(51) Int. Cl.
*B65D 75/58* (2006.01)
*B65D 33/16* (2006.01)
(Continued)

(52) U.S. Cl.
CPC ..... *B65D 75/58* (2013.01); *B05C 17/00513* (2013.01); *B65D 33/1641* (2013.01); *B65D 51/222* (2013.01); *B65D 75/5872* (2013.01); *B05C 17/00583* (2013.01)

(58) Field of Classification Search
CPC ..... B05C 17/00503; B05C 17/00513; B65D 51/222; B65D 75/58; B65D 75/5872; B65D 33/1641
USPC ..... 222/386, 325, 81–83, 105, 326
See application file for complete search history.

(56) References Cited

U.S. PATENT DOCUMENTS 1,397,510 A * 11/1921 Grassi ..... 425/376.1
1,925,466 A * 9/1933 Simpson ..... 222/81
(Continued)

FOREIGN PATENT DOCUMENTS

AT 383329 B 6/1987
DE 3500625 A1 * 8/1985
(Continued)

OTHER PUBLICATIONS

PCT/EP2012/058790 International Search Report and Written Opinion dated Aug. 3, 2012, 15 pages.

*Primary Examiner* — Donnell Long
(74) *Attorney, Agent, or Firm* — Fitch, Even, Tabin & Flannery LLP

(57) ABSTRACT

The present invention relates to packaging combination for accommodating and dispensing a viscous or granular filling material. The packaging combination comprises a tubular casing having a first end and a second end, wherein the tubular casing is closed at its first as well as its second end by a closure means. The packaging combination further comprises a dispensing device having a passageway extending through the dispensing device with an inlet opening at its one end and a dispensing opening at its other end for guiding and dispensing the filling material in a dispensing direction, and being attached to the first end closed tubular casing.

28 Claims, 11 Drawing Sheets

(51) Int. Cl.
*B05C 17/005* (2006.01)
*B65D 51/22* (2006.01)

(56) References Cited

U.S. PATENT DOCUMENTS

| | | | | | |
|---|---|---|---|---|---|
| 2,865,458 | A | * | 12/1958 | Simoncini et al. | 169/35 |
| 2,903,161 | A | * | 9/1959 | Stahmer | 222/81 |
| 3,541,647 | A | * | 11/1970 | Marietta, Jr. | 24/30.5 W |
| 8,622,244 | B2 | * | 1/2014 | Stoeckli et al. | 222/83 |
| 8,690,012 | B2 | * | 4/2014 | Stoeckli et al. | 222/82 |
| 2002/0020718 | A1 | * | 2/2002 | Summons et al. | 222/327 |
| 2002/0102375 | A1 | * | 8/2002 | Amano et al. | 428/36.9 |
| 2007/0272571 | A1 | | 11/2007 | Czopor et al. | |
| 2008/0274313 | A1 | | 11/2008 | Hanten | |
| 2009/0236365 | A1 | | 9/2009 | Summons et al. | |
| 2013/0206790 | A1 | * | 8/2013 | Pauze et al. | 222/105 |

FOREIGN PATENT DOCUMENTS

| | | | |
|---|---|---|---|
| DE | 3831225 | A1 | 3/1990 |
| DE | 19964027 | A1 | 7/2001 |
| DE | 102008040748 | A1 | 1/2010 |
| EP | 1988032 | A1 | 11/2008 |
| EP | 2058234 | A1 | 5/2009 |
| EP | 2157026 | A1 | 2/2010 |
| FR | 2741551 | A3 | 5/1997 |
| GB | 227239 | A | 1/1925 |
| JP | 10-101155 | A | 4/1998 |

* cited by examiner

PACKAGING COMBINATION

This application is a National Stage entry of International Application No. PCT/EP2012/058790, filed May 11, 2012, which claims priority to European Patent Application Nos. 11003880.9 filed May 11, 2011, 11006613.1 filed Aug. 10, 2011, and 12000555.8 filed Jan. 27, 2012, each of which were filed with the European Patent Office, all of which are hereby incorporated by reference.

BACKGROUND OF THE INVENTION

The present invention relates to a packaging combination for accommodating and dispensing a viscous or granular filling material according to claims 1, 13 and 28. The present invention further relates to a dispensing device according to claim 26 or 42 for being attached to a tubular casing as well as to a tubular casing to which a dispensing device according to claim 26 or 42 may be attached.

In particular, the present invention relates to a packaging combination for accommodating and dispensing a viscous or granular filling material, the packaging combination comprises a tubular casing having a first and a second end, wherein the tubular casing is partially filled with filling material and closed at its first as well as its second end by a closure means, like a closure clip, and wherein the packaging combination further comprises a dispensing device.

In practice, packaging combinations comprising a tubular casing filled with filling material and closed at its ends by closure means, and a dispensing device are known. The tubular casings of said packaging combinations are filled with various pasty filling materials, e.g. food stuff, like sausage meat, or adhesives, like silicone, etc.

From EP patent application 1 988 032, a tubular or sausage-shaped packaging is known, being filled with sausage meat. The sausage-shaped product is produced by closing a tubular casing at one end, filling the sausage meat into said tubular casing and closing the filled tubular casing at its respective other end. In order to allow an easier opening of the sausage-shaped product, perforation lines including a number of weak locations are provided on the casing, along which the casing may be opened by pulling off the casing material and dispensing the sausage meat.

In US patent application 2008/0274313, a sausage-shaped product similar to that of EP 1 988 032 is disclosed. In order to allow an easier opening of the casing material, a handle in form of a tear stripe is attached to the casing, particular between the two overlapping longitudinal edges of the casing material. Two material weakenings are provided at both sides of the tear stripe facilitating the opening of the casing.

Moreover, German laid open document 38 31 225 discloses a device for dispensing the filling material stored in a tubular or bag-shaped packing. The device includes a rigid tube having a dispensing nozzle at its one end. A bag-shaped casing has then to be containing a pasty filling material, like an adhesive, has to be opened at one end and has then to be positioned in said rigid tube with its opened end facing the dispensing nozzle. A piston matching the inner diameter of the tube is pushed into the tube, thereby squeezing the bag-shaped packaging and dispensing the filling material through the dispensing nozzle.

With this known packaging combination, it is of disadvantage that the rigid tube has outer circumferential dimensions being such that the complete bag-shaped casing can be accommodated in said rigid tube. If this known packaging combination is provided as a disposable device, this solution is expensive due to the big rigid tube being made from relatively expensive plastics. If this known packaging combination used such that only bag-shaped casing is thrown away and the rigid tube is used several times, the bag-shaped casing must be opened outside the tube so that, when the opened bag-shaped casing is introduced in the rigid tube, filling material can accidently discharged and can pollute the environment.

Thus, it is an object of the present invention to provide a packaging combination, with which the above mentioned drawbacks have been overcome, and which allows an easy and save opening of the tubular casing.

SUMMARY OF THE INVENTION

As a first embodiment, according to the present invention, there is provided a packaging combination for accommodating and dispensing a viscous or granular filling material, the packaging combination comprises a tubular casing having a first and a second end, wherein the tubular casing is partially filled with filling material and closed at its first as well as its second end by a closure means, like a closure clip, wherein the partially filled tubular casing comprises a plait-like portion at its first end being at least approximately free of filling material. The packaging combination further comprises a dispensing device having a passageway extending through the dispensing device with an inlet opening at its one end and a dispensing opening at its other end for guiding and dispensing the filling material in a dispensing direction, and being attached to the first end of the partially filled and closed tubular casing. The plait-like portion of the tubular casing extends through the passageway and beyond the dispensing opening of the dispensing device such that the closure means closing said first end is arranged outside the dispensing opening.

This configuration of a packaging combination enables a safe and easy opening of the tubular casing by removing the closure means extending beyond the dispensing opening and dispensing the filling material just by squeezing the filled tubular casing portion. Thus, an accidental discharge of filling material due to the used to introduce the casing into a dispensing tube is avoided.

In an advantageous configuration of the packaging combination according to the present invention, the dispensing device includes at least a first and a second portion, wherein the first portion extends from the inlet opening of the passageway in the dispensing direction and the second portion extends from the dispensing opening opposite to the dispensing direction, and wherein the inner circumferential dimensions of the first portion corresponds at least approximately to the outer circumferential dimensions of the tubular casing.

That means that the cross-section of the first portion of the dispensing device corresponds to the cross-section of the tubular casing, i.e. both, the first portion and the tubular casing, are of a circular cross-section, whereby the outer diameter of the tubular casing corresponds to the inner diameter of the first portion of the dispensing device. This allows a form-fit attachment of the dispensing device to the filled tubular casing. The term "circumferential dimension" has not only to be understood as the sole circumference, but also as a dimension characterizing a cross-section, like the length or width of a rectangle, a side length of a triangle or a diameter of a circle. Naturally, the first portion of the dispensing device and the tubular casing may be of any other suitable form, i.e. of a rectangular or triangular shape, the remarkable point is that their cross sections or circumferential dimensions correspond to each other.

In a further advantageous configuration, the inner circumferential dimensions of the second portion of the dispensing device are smaller than the inner circumferential dimensions of the first portion of the dispensing device. Thereby, the dispensing opening is smaller than the outer diameter of the tubular casing, which allows a more precise dispensing of the filling material.

In case that the first portion and the second portion of the dispensing device are coupled directly with each other, the dispensing opening is fixedly positioned relative to the second portion of the dispensing device and also to the tubular casing attached to the dispensing device.

According to the present invention, the packing combination includes a closure cap reversibly attachable to the dispensing device for releasing and closing the dispensing opening. A reversibly attachable closure cap reliably prevents the filling material from unintentionally escaping from the packaging combination and further allows storing and reusing an opened packaging.

For releasing and closing the dispensing opening by a closure cap, the dispensing device has an external screw thread at its outside and the closure cap has a corresponding internal screw thread at its inside for being attached to the external screw thread of the dispensing device. Alternatively, the dispensing device may have an internal screw thread at its inner surface. In this case, the closure cap has a corresponding outer screw thread at its outer surface. In this alternative constitution of the closure cap, its inner surface may be designed independently from said screw thread and may have any desired inner shape.

In an advantageous configuration of the packaging combination, the closure cap has a clearance arranged inside the closure cap and behind the internal screw thread in the dispensing direction, for accommodating the first end of the closed tubular casing, when attached to the dispensing device. This clearance prevents the plait-like portion of the partially filled tubular casing from being pushed back into the dispensing device and allows an easy capturing the closure means attached to the plait-like portion and removing therefrom.

In a further advantageous configuration of the inventive packaging combination, at least one cutting element is arranged inside the closure cap in a region between the threaded portion and the clearance. Said cutting element may automatically remove the closure means from the plait-like portion of the tubular casing, when being opened for the first time.

It has to be understood that the cutting element should be of a configuration to act only in one direction, namely the removal or screw-off direction to avoid a damaging of the plait-like portion when the closure cap is attached to the dispensing device. Thus, the at least one cutting element is adapted to cut-off the portion of the first end being provided with the closure means, from the tubular casing when the closure cap is removed from the dispensing device for the first time.

In a preferred constitution, an indicating unit for indicating the originality of the closure of the dispensing opening provided at the dispensing device. Alternatively, the indicating unit may be attached to the closure cap. Said indicating unit surely displays whether or not the inventive packaging combination has already been opened.

As mentioned above, the dispensing device is attached to the tubular casing for forming the inventive packaging combination. To avoid the dispensing device from dropping off from the tubular casing, the dispensing device is secured to the first end of the tubular casing by an adhesive, in particular, by a hot-melt adhesive. Naturally, in case that sensitive filling materials are filled into the tubular casing, other adhesive means, like an adhesive tape, may be used, which e.g. may not be heated.

In a further preferred configuration, the packaging combination comprises a dispensing nozzle having an internal screw thread for being reversibly attachable to the external screw thread of the dispensing device. Said nozzle may at least partially have a cone-shape to be cut-off to adapt the size of the opening of said nozzle to the intended use.

As a second embodiment, according to the present invention, there is further provided a packaging combination for accommodating and dispensing a viscous or granular filling material, the packaging combination comprises a tubular casing having a first and a second end, wherein the tubular casing is partially filled with filling material and closed at its first as well as its second end by a closure means, like a closure clip, wherein the partially filled tubular casing comprises a plait-like portion at its first end being at least approximately free of filling material. The packaging combination further comprises a dispensing device having a passageway extending through the dispensing device with an inlet opening at its one end and a dispensing opening at its other end for guiding and dispensing the filling material in a dispensing direction, and being attached to the first end of the partially filled and closed tubular casing. The plait-like portion of the tubular casing extends through the passageway and beyond the dispensing opening of the dispensing device such that the closure means closing said first end is arranged outside the dispensing opening. Moreover, at least the dispensing device comprises leastwise an element opening means for opening the tubular casing.

This configuration of a packaging combination enables a safe and easy opening of the tubular casing by removing the closure means extending beyond the dispensing opening by means of the opening means and a safe and easy dispensing of the filling material just by squeezing the filled tubular casing portion. Thus, an accidental discharge of filling material due to the force used to introduce the casing into a dispensing tube is avoided.

In an advantageous configuration, and analogous to the first embodiment, also the dispensing device of the second embodiment of the packaging combination according to the present invention includes at least a first and a second portion, wherein the first portion extends from the inlet opening of the passageway in the dispensing direction and the second portion extends from the dispensing opening opposite to the dispensing direction, and wherein the inner circumferential dimensions of the first portion corresponds at least approximately to the outer circumferential dimensions of the tubular casing.

In a further advantageous configuration, the inner circumferential dimensions of the second portion of the dispensing device are smaller than the inner circumferential dimensions of the first portion of the dispensing device. Thereby, the dispensing opening is smaller than the outer diameter of the tubular casing, which allows a more precise dispensing of the filling material.

As stated above, according to the present invention, leastwise an element of the opening means can be arranged at the dispensing device. In a preferred embodiment, one opening means are entirely provided at the dispensing device, This provides a simple and cheap solution for opening the tubular casing. In principle, one opening means are sufficient. However, several opening means can be provided at the dispensing device, for example in a constant distance in the circumferential direction of the dispensing device.

In a preferred configuration according to the second embodiment of the present invention, opening means are formed by a preferably V-shaped cutout in the dispensing device. For opening the inventive packaging combination, the closure means of the first end of the tubular casing may easily be removed by pulling the plait-like portion through said cutout.

For facilitating an easy cutting of the plait-like portion, the opening means includes at least one cutting element. In one embodiment, said cutting element can be a cutting edge in said V-shaped cutout.

In a further configuration, the opening means is a cutout in the dispensing device and includes at least one cutting element being provided within the cutout and projecting into the clearance of the cutout. The cutout may have any desired shape, like a U-shape, and the cutting element may be a projection integrally formed with the dispensing device, like an arbor extending, for example, from the bottom section of the cutout. Naturally, the cutting element may also be blade-shaped and may project from any suitable wall portion of the cutout. Alternatively, the opening means may be a W-shaped cutout, wherein the central tip of the W forms the cutting element including a sharpened tip end or sharpened edges for opening the tubular casing. The cutting element may also be a separate element being inserted into the cutout, like a metal plate or a needle having sharpened edges and being inserted in a wall section of the cutout. It has to be noted, that the cutting element preferably, but not exclusively, should project into the clearance of the cutout to prevent an unintentional damage of the casing material.

For preventing the filling material from unintentionally escaping from the packaging combination and further allowing storing and reusing an opened packaging, also the packing combination according to the second embodiment of the present invention includes a closure cap reversibly attachable to the dispensing device for releasing and closing the dispensing opening.

In a further advantageous configuration, at least one element of the opening means is provided at the dispensing device and at least another element of the opening means is provided at the closure cap. Both elements of the opening means may be configured to engage each other for securely open the tubular casing.

The at least one element of the opening means, advantageously be provided at the dispensing device, may be adapted to hold the first end of the tubular casing such that the closure means are placed outside the dispensing device and that the at least one element of the opening means provided at the closure cap is adapted to cutoff the first end of the tubular casing together with the closure means. This configuration of the elements of the opening means enables a safe and reliable opening of the tubular casing by cutting off the first end of the tubular casing.

In a preferred configuration, the closure cap is provided with abutment means and the at least one element of the opening means provided at the closure cap is arranged, directed in the abutment direction of the closure cap to the dispensing device, behind the abutment means. The abutment direction is directed opposite to the dispensing direction, such that, by closing the dispensing device with the closure cap for the first time, the abutment means provided inside the closure cap, abut against the dispensing opening of the dispensing device.

The abutment means thereby preventing an unintentional cutting off of the first end of the tubular casing when closing the dispensing device with the closure cap for the first time. The abutment means may be formed by a notch or lug provided at the inside of the closure cap in a central region of its internal screw thread. Naturally, more than one notch or lug may be provided in the closure cap, e.g. for adjusting a desired break force for breaking off the abutment means when opening the tubular casing for the first time. Said abutment means, as well as the element of the opening means provided at the closure cap, may be of the same material as the closure cap and may integrally be formed thereto. The element of the opening means, in a simple case, may be a sharp edge formed to a pitch of the internal screw thread, or may be a separate element, like a blade-shaped notch.

Furthermore, according to the present invention, the abutment means are adapted to be broken with the first opening of the packaging combination. The broken abutment means may thereby indicate that the packaging combination has already been open and thus, may prevent an accidental outflow of the filling material.

It is further advantageously, that for the first closing of the packaging combination, the closure cap is adapted to be closed on the dispensing device until reaching the abutment means and that, for the first opening of the packaging combination, the closure cap is adapted to be moved further in the abutment direction for breaking the abutment means and for bringing in engagement the at least one element of the opening means provided at the dispensing device, with the first end of the tubular casing provided at the at least one element of the opening means arranged at the dispensing device for cutting off the first end of the tubular casing together with the closure means. In this configuration, the abutment means, on one hand, provide a resistance when closing the closure cap for the first time on the dispensing device, thereby preventing an unintentional or accidental opening. On the other hand, closing the closure cap up to the end without any resistance, may be an indication for the tubular casing to already be open.

In a preferred constitution, an indicating unit for indicating the originality of the closure of the dispensing opening is provided at the dispensing device. Alternatively, the indicating unit may be attached to the closure cap. Said indicating unit surely displays whether or not the inventive packaging combination has already been opened.

As mentioned above, the dispensing device is attached to the tubular casing for forming the inventive packaging combination. To avoid the dispensing device from dropping off from the tubular casing, the dispensing device is secured to the first end of the tubular casing by an adhesive, in particular, by a hot-melt adhesive. Naturally, in case that sensitive filling materials are filled into the tubular casing, other adhesive means, like an adhesive tape, may be used, which e.g. may not be heated.

In a further preferred constitution, the packaging combination comprises a dispensing nozzle having preferably an internal screw thread for being reversibly attachable to the external screw thread of the dispensing device. Said nozzle may at least partially have a cone-shape to be cut-off to adapt the size of the opening of said nozzle to the intended use.

As a third embodiment, according to of the present invention, there is provided a packaging combination for accommodating and dispensing a viscous or granular filling material. The packaging combination comprises a tubular casing having a first end, a second end and a central Axis extending through first end second ends, wherein the tubular casing is tightly filled with filling material and closed at its first and second end by a closure means, like a closure clip. The packaging combination further comprises a dispensing system which includes a dispensing device having a passageway extending through the dispensing device with an inlet opening at its one end and an outlet opening at its other end for guiding and dispensing the filling material in a dispensing direction, and being attached to the first end of the tightly filled tubular casing. The first end of the tubular casing extends into the passageway of the dispensing device. The dispensing system further comprises a dispensing cap having an attachment end and a dispensing end, which is reversibly attachable to the outlet opening of the dispensing device, by its attachment end.

A packaging combination of this configuration already includes all necessary parts for easy and safe dispensing the filling material contained in the tubular casing just by squeezing the filled tubular casing portion. Moreover, since the dispensing system is already attached to the filled tubular casing, an accidental discharge of filling material after opening the tubular casing and before inserting the opened casing into a dispensing tube is avoided.

In order to allow an easy opening of the tightly filled tubular casing, the dispensing cap comprises at least one cutting element for opening the tubular casing at its first end.

In an advantageous configuration, the at least one cutting element extends from the attachment end of the dispensing cap in a direction opposite to the dispensing direction. Thereby, the tightly filled tubular casing may be opened just by firmly attaching the dispensing cap to the second portion of the dispensing device.

In a further advantageous configuration of the inventive packaging combination, the dispensing cap further comprises a cap member having a central axis, an opened end and a closed end, arranged at the attachment end of the dispensing cap and coaxially aligned to central axis, with its opened end directed towards the tubular casing.

In this configuration, the cap member is positioned above the closure clip closing the first end of the tubular casing, for accommodating the plait-like portion together with said closure clip, when the tubular casing has been opened by the cutting element. The cap member prevents the plait-like portion together with said closure clip from blocking the dispensing end of the dispensing cap.

For positioning said cap member above the first end of the tubular casing, the cap member is advantageously arranged inside the dispensing cap, in closed vicinity to its attachment end. Moreover, for fixing the cap member, and for allowing the filling material passing the cap member, at least one bar is provided, by means of which the cap member is attached to the dispensing cap. Between cap member and the inner surface of the dispensing cap, thereby, an at least approximately circular or partially circular slot is formed for allowing the filling material passing the cap member. Naturally, more than one bar may be provided for attaching the cap member to the dispensing cap. Accordingly more than one partially circular slot is formed.

In case that the dispensing cap comprises said cap member, the at least one cutting element may be arranged in the region of the opened end of the cap member. The opened end of the cap member terminates in an annular or circular ring shaped surface, which is arranged in a plane parallel to the attachment end of the dispensing cap. Further advantageously, the opened end of the cap member and the attachment end of the dispensing cap lying in a common plane extending at least approximately rectangular to the central axis of the tubular casing.

To guarantee that a packaging combination is originally closed, an indicating unit for indicating the originality of the closure is provided at the dispensing system.

Further advantageously, in the originally closed condition of the packaging combination, the indicating unit is adapted to fix the dispensing cap in a predefined position relative to the dispensing device. Thereby, the tubular casing is not unintentionally damaged by the cutting element extending from the attachment end of the dispensing cap.

Also, according to the third embodiment of the packaging combination of the present invention, the dispensing device includes at least a first portion and a second portion, wherein the first portion extends from the inlet opening of the passageway in the dispensing direction and the second portion extends from the outlet opening opposite to the dispensing direction, and wherein the inner circumferential dimensions of the first portion corresponds at least approximately to the outer circumferential dimensions of the tubular casing.

In a further advantageous configuration, a circumferential flange extends at the inner surface of the dispensing device in a region between the first portion and the second portion. Said circumferential flange provides a stop or abutment for restricting the insertion depth of the first end of the tubular casing into the first portion of the dispensing device. Moreover, said flange or the circumferential edge between the flange and the second portion of the dispensing device provide a place for position an adhesive, like a hot-melt adhesive or the like, in order to fix the dispensing device on the tubular casing for avoiding the dispensing device from dropping off from the tubular casing.

According to a preferred constitution of the inventive packaging combination, an internal screw thread is provided at the outlet opening of the dispensing device, and a corresponding external screw thread is provided at the attachment end of the dispensing cap for being attached to the outlet opening of the dispensing device. By means of said screw thread combination, the dispensing cap may securely be attached to the dispensing device. Alternative attachment means may be used to attach the dispensing cap to the dispensing device, like a bayonet connector including pins extending from the dispensing cap and corresponding slots in the second portion of the dispensing device, for accommodating said pins.

In an advantageous configuration of the inventive packaging combination, the dispensing cap comprises a protrusion extending at its outside in the region of the end of the external screw tread directed towards the dispensing opening, for restricting its screw-in depth. Additionally, said protrusion may also assist securing the dispensing cap when firmly attached to the second portion of the dispensing device, by a frictional force between said protrusion and the outer edge of the outlet opening of the second portion of the dispensing device.

In a preferred constitution, the indicating unit is a tear-off strip provided between the outlet opening of the dispensing device and the protrusion extending from the dispensing cap. Said tear-off strip may be removed by hand without the need of without any additional tool. The indicating unit, and in particular, the tear-off strip, when positioned between the outlet opening of the dispensing device and the protrusion extending from the dispensing cap, prevents the dispensing cap from being firmly attached to the dispensing device. Thus, the first end of the tubular casing is prevented from being opened, by maintaining a distance between the outlet opening of the dispensing device and the protrusion extending from the dispensing cap by means of the indicating unit.

To enhance securing the dispensing cap when attached to the second portion of the dispensing device, and to provide a save and well visible indication of the originality of the closure, the protrusion extending from the dispensing cap is an annular protrusion surrounding the dispensing cap, and the indicating unit is a tear-off strip surrounding the dispensing cap between the outlet opening of the dispensing device and the annular protrusion.

In order to prevent the tubular casing from being unintentionally damaged by the cutting element of the dispensing cap, the indicating unit has a height which is larger than the length of the cutting element in the dispensing direction. This indicating unit secures the dispensing cap, and thereby the tip end of the cutting element, at a distance from the first end of the filled tubular casing, which may be predefined according to the selected height of the tear-ff strip.

Further advantageously, a dispensing opening is provided at the dispensing end of the dispensing cap, via which the filling material may be dispensed after the tubular casing has been opened.

For avoiding an unintentional waste of filling material after the tightly filled tubular casing has been opened, a closure cap is provided reversibly attachable to the dispensing cap.

The object of the present invention may also be solved by a dispensing device for being attached to a tubular casing to form a packaging combination according to the invention described above.

Further advantages and a preferred embodiment will be described in the following together with the drawings listed below. The expressions "left", "right", "below" and "above" are referred to the drawings in an alignment such that the reference numbers used can be read in normal.

DETAILED DESCRIPTION

Figure 1:
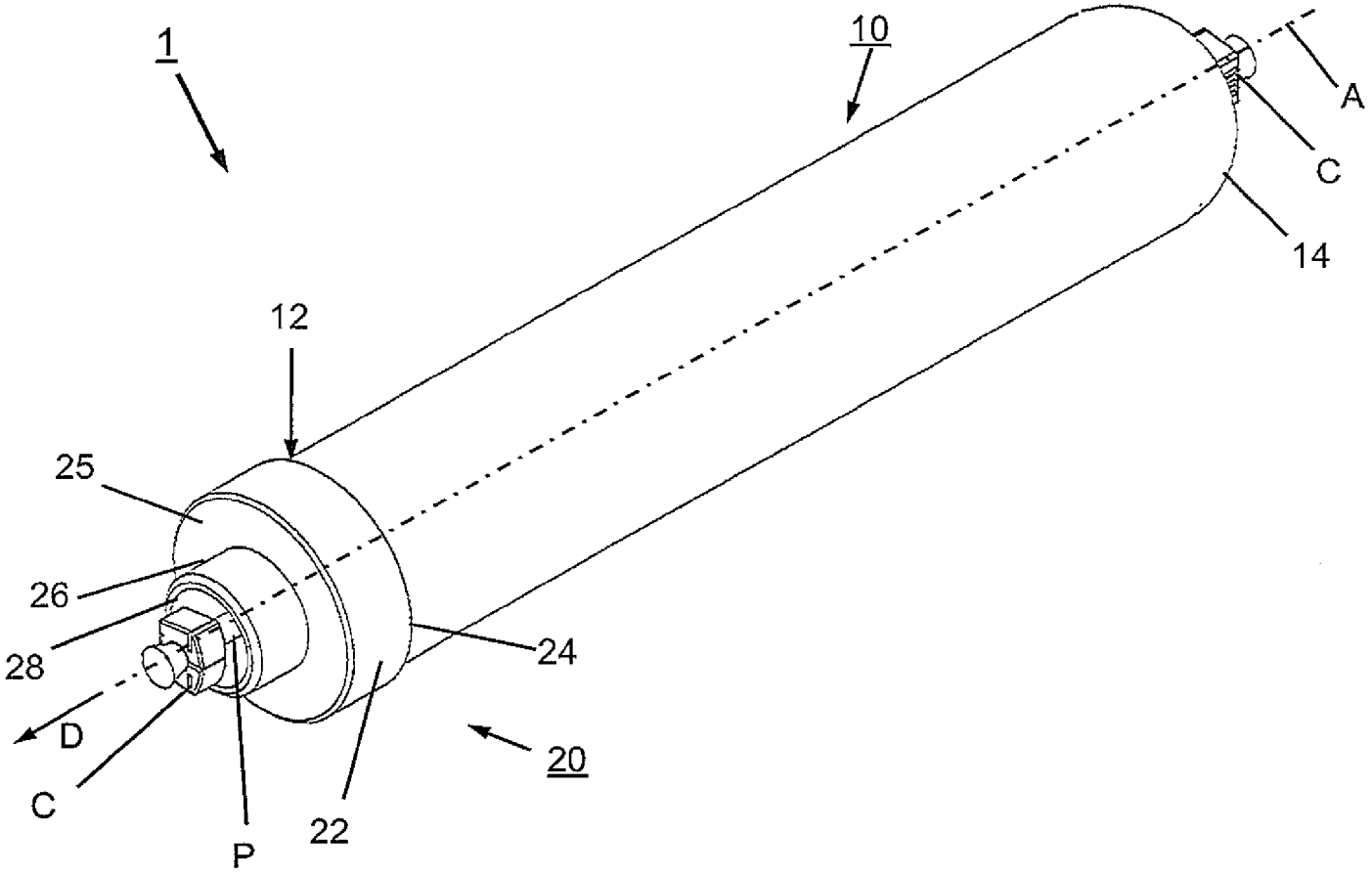
FIG. 1: is a perspective view to the first embodiment of the packaging combination according to the present invention.

FIG. 1 shows a perspective view to the first embodiment of the packaging combination 1 according to the present invention. The packaging combination 1 includes a sausage-shaped tubular casing 10 having a first end 12 and a second end 14 both closed by closure clips C, and a dispensing device 20 attached to the first end of 12 of tubular casing 10. Tubular casing 10 has a central axis A extending through first end 12 and second end 14. Dispensing device 20 has a first portion 22 including an inlet opening 24 and a second portion 26 including an outlet or dispensing opening 28. As it further can be seen in FIG. 1, first end 12 of tubular casing 10 has a plait-like portion P which extends through dispensing device 20 via inlet opening 24 and dispensing opening 28. Thereby, closure clip C closing first end 12, projects from dispensing opening 28 in the dispensing direction D.

In the embodiment of packaging combination 1 according to FIG. 1, tubular casing 10 is of a circular cross-section. Accordingly, also dispensing device 20 is of a generally circular cross-section, at least for the first portion 22. First portion 22 of dispensing device 20 has an inner and outer cylindrical shape having an inner diameter which corresponds to the outer diameter of tubular casing 10. Second portion 26 which also has an inner and outer cylindrical shape, is directly coupled to first portion 22 in the dispensing direction D via an annular offset 25. First portion 22, annular offset 25 and second portion 26 are coaxially arranged to central axis A of tubular casing 10. Moreover, the axial length of dispensing device 20 is clearly shorter than the axial length of the tubular casing 10. Thereby, dispensing device 20 is preferably made of plastics.

Figure 2:
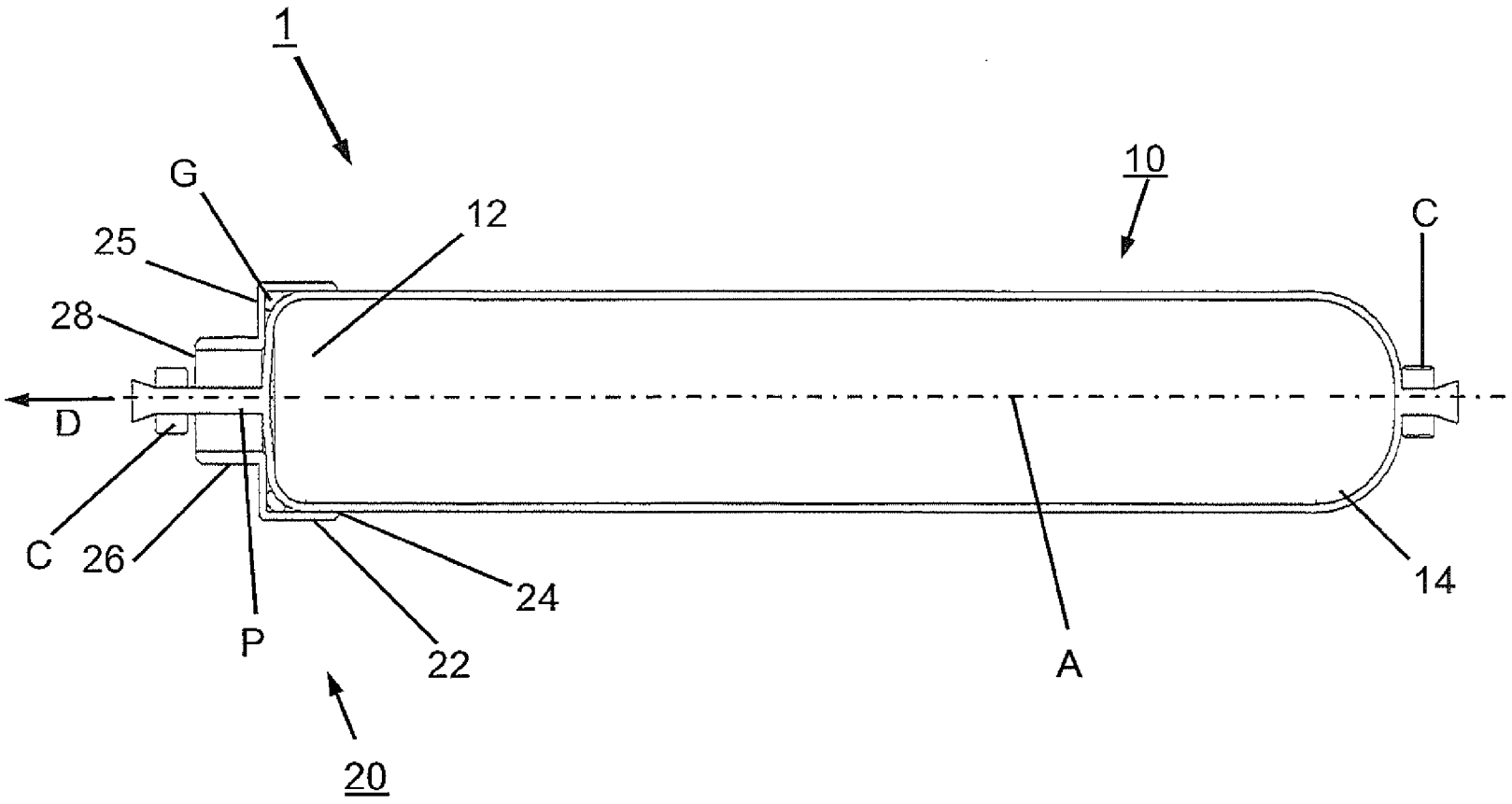
FIG. 2: is a longitudinal-section to the embodiment of the packaging combination of FIG. 1.

FIG. 2 shows a longitudinal-section along central axis A of the embodiment of the packaging combination 1 of FIG. 1. As it can be seen in FIG. 2, the outer diameter of tubular casing 10 corresponds to the inner diameter of the first portion 22 of dispensing device 20. Annular offset 25 and first portion 22 are approximately rectangular aligned to each other, thereby forming a flange surrounding the outer edge of first end 12 of tubular casing 10. Between inlet opening 24 and dispensing opening 28, then extends a passageway formed by the inner walls of the first and second portion 22, 26 of the dispensing device 20.

For fixedly attaching dispensing device 20 to tubular casing 10, an adhesive G, preferably a hot-melt adhesive, is disposed at the inside of the flange formed by annular offset 25 and first portion 22. The amount of adhesive G is sufficient for at least approximately filling the gap between first end 12 of tubular casing 10, annular offset 25 and first portion 22 of dispensing device 20.

Plait-like portion P at the first end 12 of tubular casing 10, which is at least approximately free from filling material and which has been formed in a known manner during filling and closing tubular casing 10, has a length that corresponds to the axial length of the second portion 26 of dispensing device 20. The length of plait-like potion P is at least equal to the axial length of the second portion 26 of dispensing device 20 in order to ensure that closure clip C closing the first end 12 of tubular casing 10 projects from outlet opening 28 of dispensing device 20 in the dispensing direction D. It has to be understood that, for attaching dispensing device 20 to first end 12 of tubular casing 10, the inner diameter of the second portion 26 of dispensing device 20, forming the dispensing opening 28, has to be at least slightly larger than the outer diameter of the closed closure clip C attached to first end 12. Accordingly, in order to open the packaging combination 1, closure clip C of first end 12 may be gripped and removed from first end 12 of tubular casing 10 and the filing material stored in tubular casing 10 may be dispensed by squeezing tubular casing 10.

Figure 3:
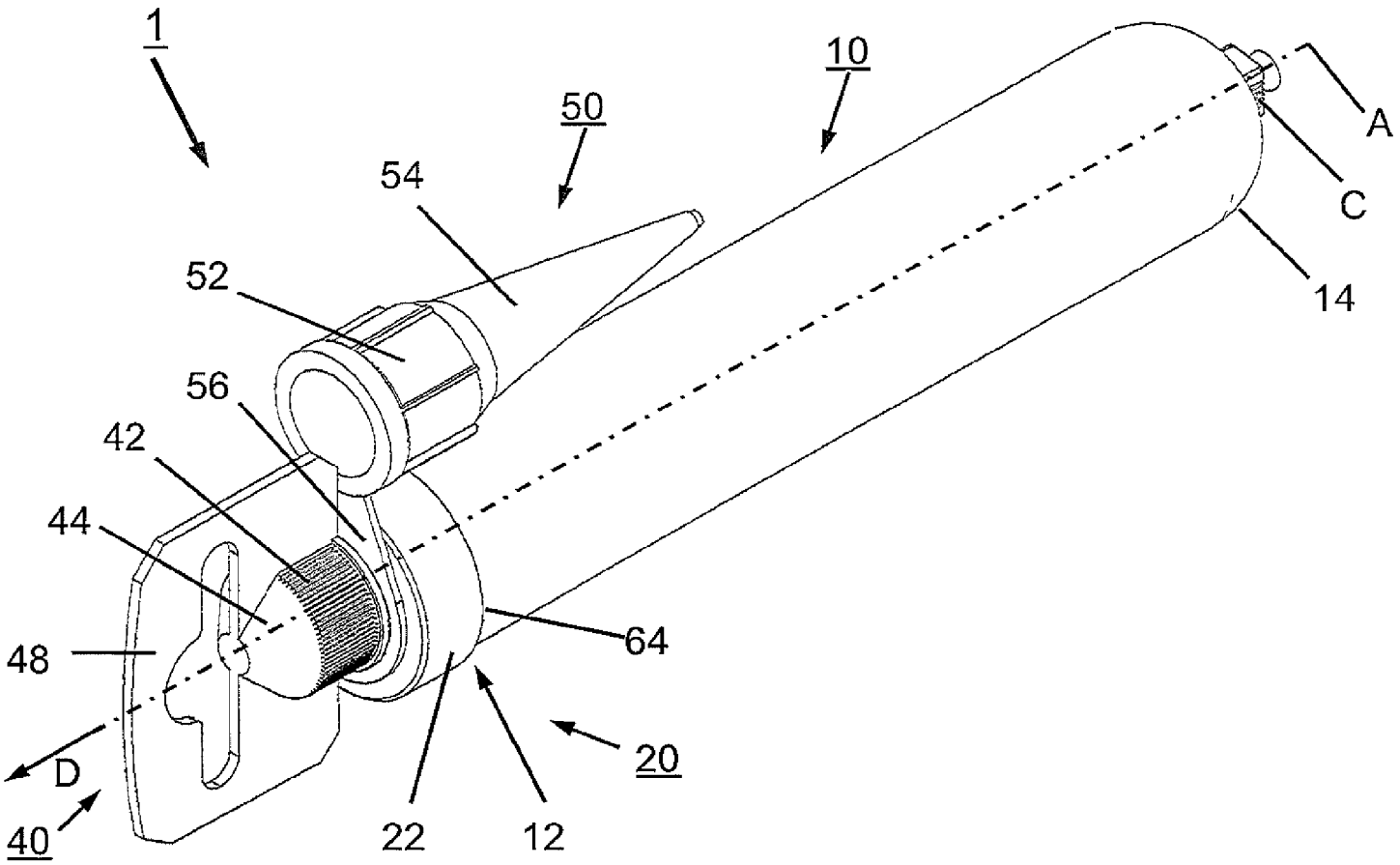
FIG. 3: is a perspective view to the packaging combination according to FIGS. 1 and 2, including a closure cap and a dispensing nozzle.

As it can be seen in FIG. 3, the packaging combination 1 according to the first embodiment, includes the tubular casing 10 having a first end 12, a second end 14 as well as a plait-like portion P and the dispensing device 20 having a first portion 22 including an inlet opening 24 and a second portion 26 including an outlet opening 28, both known from the embodiment according to FIGS. 1 and 2.

Additionally, the packaging combination 1 includes a closure cap 40 for closing dispensing opening 28 of dispensing device 20 and a dispensing nozzle 50 for being attached to the dispensing opening 28, in order to dispense a desired amount of filling material.

Closure cap 40 includes a cylindrical portion 42 having a first end 42*a* and a second end 42*b* and a conical portion 44 being attached to second end 42*b* of cylindrical portion 42. As it can be seen in FIG. 4, which is a longitudinal-section to the embodiment of the packaging combination 1 of FIG. 3, the inner diameter of cylindrical portion 42 corresponds to the outer diameter of second portion 26 of dispensing device 20. The axial length of cylindrical portion 42 is at least approximately equal to the axial length of second portion 26 of dispensing device 20. As it can be seen in FIG. 4, cylindrical portion 42 is slightly longer than cylindrical portion 42. Together with hollow conical portion 44, inside closure cap 40, a clearance 46 is provided for accommodating the first end 12 of tubular casing 10 or at least closure clip C closing said first end 12 and extending beyond dispensing opening 28 in the dispensing direction D, when closure cap 40 is attached to dispensing device 20.

In order to reversibly attach and release closure cap 40 to or from dispensing device 20, in particular to or from second portion 26 of dispensing device 20, an inner screw thread is provided at the inner surface of cylindrical portion 42 of closure cap 40, which matches with an outer screw thread provided at the outer surface of second portion 26 of dispensing device 20.

Figure 4:
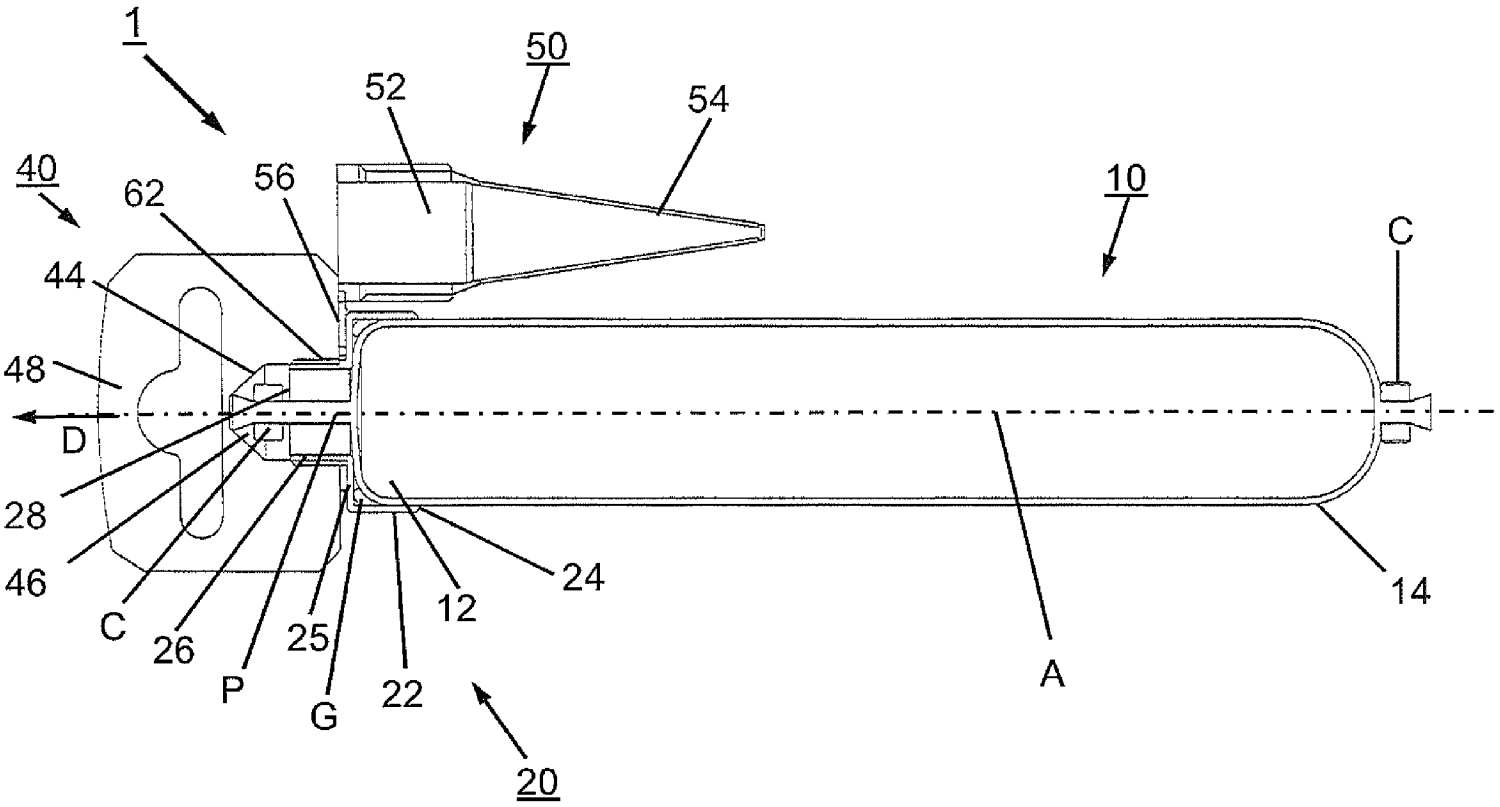
FIG. 4: is a longitudinal-section to the embodiment of the packaging combination of FIG. 3.

Closure cap 40 according to FIGS. 3 and 4 further comprises a flat fin member 48 arranged in a plane extending through longitudinal axis A of tubular casing 10, when being attached to dispensing device 20. Flat fin member 48 is coupled to the outside of cylindrical portion 42 and conical portion 44, and includes an opening arranged above conical portion 44 in the dispensing direction D. Fin member 48 thereby forms a hanger. For an easier opening of closure cap 40, the outer surface of cylindrical portion 42 is provided with grooves extending parallel to axis A.

As mentioned above, packaging combination 1 of FIGS. 3 and 4 further includes dispensing nozzle 50. Dispensing nozzle 50 has a hollow cylindrical portion 52 and a hollow conical portion 54 coupled to cylindrical portion 52. At the inner surface of cylindrical portion 52, an inner screw thread is provided matching with outer screw thread of second portion 26 of dispensing device 20 for reversibly attaching dispensing nozzle 50 thereto. Hollow conical portion 54 is open at its one end, which is coupled to conical portion 54 and closed at its other end forming a tip. In order to allow filling material to be dispensed through dispensing nozzle 50, the tip has to be cut off. The size or diameter of the dispensing opening of nozzle 50 depends on the position of the cutoff at conical portion 54 of dispensing nozzle 50. Nozzle 50 further comprises a flap element 56 extending radially from cylindrical portion 52 and including a circular opening for securing dispensing nozzle 50 to second portion 26 of dispensing device 50.

Closure cap 40 may comprise at least one cutting element (not shown) for cutting of closure clip C closing the first end 12 of tubular casing 10. Said cutting element may be arranged inside closure cap 40 in a region between cylindrical portion 42 and conical portion 44 in order to cut-off closure clip C of the first end 12 when closure cap 40 is released from packaging combination 1 for the first time. To enable this, and in order to prevent cutting-off of closure clip C from first end 12 when closure cap 40 is attached to packaging combination 1 for the first time, the cutting element is a one-directional acting cutting element, like a blade having only one cutting edge.

The packaging combination 1 according to the present invention further comprises an indicating unit (not shown) for indicating the originality of the closure of the dispensing opening. Said indicating unit may have the form of a small sheet attached to the dispensing device 20, e.g. at the outside of annular offset 25 for being coupled with closure cap 40 when being closed for the first time. When opening originally closed packaging combination 1, the indicating unit is removed from closure cap 40 and/or from annular offset 25 of dispensing device 20, indicating that packaging combination 1 is not originally closed anymore, and further indicating, in case of the presence of a cutting element inside closure cap 40, that tubular casing 10 is opened and that filling material may escape from packaging combination 1 when releasing closure cap 40. The indicating unit may also be originally attached to the closure cap 40 and may than be coupled to dispensing device 20 when being closed for the first time. Naturally, an indicating unit may also be attached to any other suitable part of the packaging combination, where its possible to indicate the originality of the closure of the dispensing device or at least of the dispensing opening.

Adhesive G provided at the inside of the flange formed by annular offset 25 and first portion 22 in order to secure dispensing device 20 to the first end 12 of tubular casing 10 has been described as being a hot-melt adhesive. Dependent on the material of tubular casing, which may be a suitable plastic foil or a natural material, the material of dispensing device 20, which is preferably made of plastic but also from any other suitable material, like a metal, the adhesive G may also be an other than a hot-melt adhesive. E.g. in case of temperature sensitive filling materials or casing material, a cold acting adhesive is required.

Figure 5:
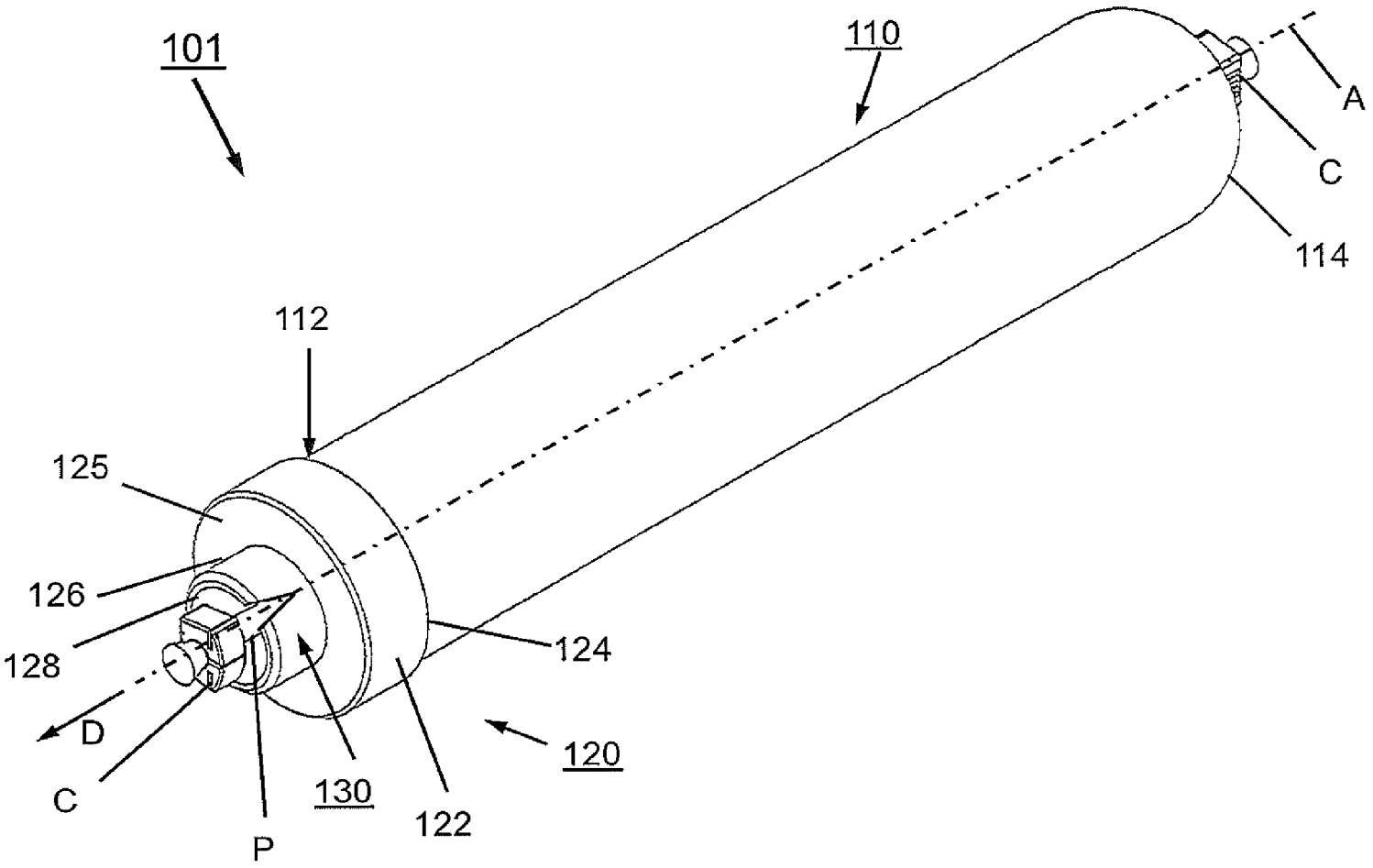
FIG. 5: is a perspective view to a second embodiment of the packaging combination according to the present invention.

FIG. 5 shows a perspective view to the second embodiment of the packaging combination 101 according to the invention. The packaging combination 101 includes a sausage-shaped tubular casing 110 having a first end 112 and a second end 114 both closed by closure clips C, and a dispensing device 120 attached to the first end of 112 of tubular casing 110. Tubular casing 110 has a central axis A extending through first end 112 and second end 114. Dispensing device 120 has a first portion 122 including an inlet opening 124 and a second portion 26 including an outlet or dispensing opening 128. As it further can be seen in FIG. 5, first end 112 of tubular casing 110 has a plait-like portion P which extends through dispensing device 120 via inlet opening 124 and dispensing opening 128. Thereby, closure clip C closing first end 112, projects from dispensing opening 128 in the dispensing direction D.

In the second embodiment of packaging combination 101 according to FIG. 5, tubular casing 110 is of a circular cross-section. Accordingly, also dispensing device 120 is of a generally circular cross-section at least for the first portion 122. First portion 122 of dispensing device 120 has an inner and outer cylindrical shape having an inner diameter which corresponds to the outer diameter of tubular casing 110. Second portion 126 which also has an inner and outer cylindrical shape, is directly coupled to first portion 122 in the dispensing direction D via an annular offset 125. First portion 122, annular offset 125 and second portion 126 are coaxially arranged to central axis A of tubular casing 110. Moreover, the axial length of dispensing device 120 is clearly shorter than the axial length of the tubular casing 110. Thereby, dispensing device 120 is preferably made of plastics.

As it can further be seen in FIG. 5, dispensing device 120 includes opening means 130 in the form of a V-shaped cutout in second portion 126. The opened or upper end of said V-shaped cutout 130 is aligned to the upper end of second portion 126 directed in dispensing direction D. The lower or tip end of said V-shaped cutout 130 and terminates in a distance to annular offset 125, which is sufficient, to enable a closure cap 40 or a dispensing nozzle 50, similar to the packaging combination 1 according to the first embodiment, covering and sealing V-shaped cutout in second portion 126, when attached thereto. The size or at least the heights of V-shaped cutout in second portion 126 may be selected to be as small as possible, i.e. to correspond to the size, like the diameter, of plait-like portion P.

Figure 6:
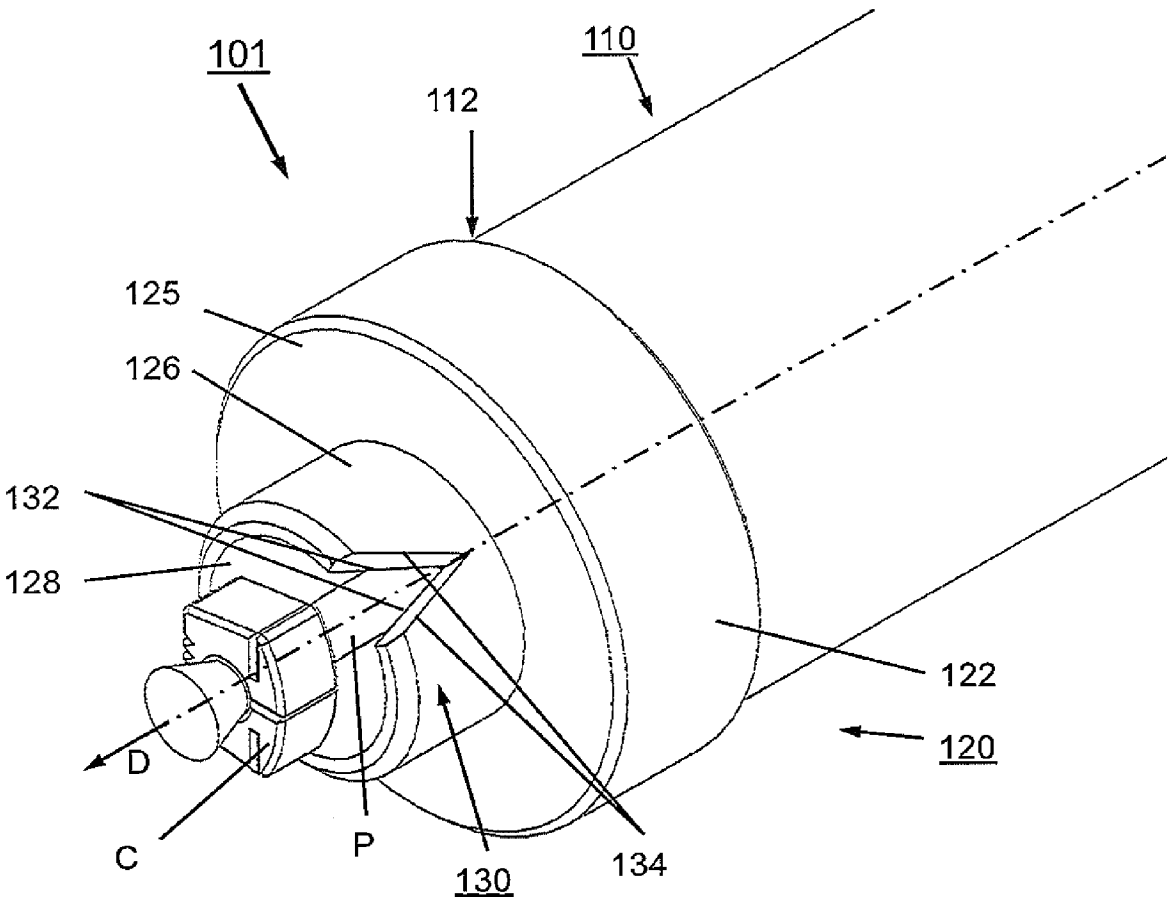
FIG. 6: is an enlarged perspective view to the first end of the packaging combination of FIG. 5.

FIG. 6 is a detailed perspective view to the first end of the packaging combination 101 as described in conjunction with FIG. 5. As shown in FIG. 6, V-shaped cutout 130 is arranged in second portion 126 of dispensing device 120 and is aligned with its upper or opened end to the upper end of second portion 126. The tip end of V-shaped cutout 130 is directed towards annular offset 125.

Due to the thickness of dispensing device 120, and in particular the thickness of second portion 126, V-shaped cutout 130 forms two approximately planar surfaces along the "V", touching each other at the tip end of V-shaped cutout 130. Said approximately planar surfaces are restricted by approximately linear inner edges 132 at the inner surface of second portion 126 and by approximately linear outer edges 134 at the outside or outer surface of second portion 126.

Inner edges 132 are sharpened for forming cutting elements, so called cutting edges. According to the embodiment of FIG. 6, the "V" formed by inner edges 132 is slightly smaller than the "V" formed by outer edges 134. Thus, plait-like portion P at first comes in contact with inner edges 132 when pulled through V-shaped cutout 130. Naturally, also outer edges 134 may be sharpened for forming cutting elements. In this case, the "V" formed by outer edges 134 should be slightly smaller than the "V" formed by inner edges 132.

For opening tubular casing 110 for dispensing the filing material, closure clip C attached to plait-like portion P is grasped and plait-like portion P is pulled through V-shaped cutout 130 along cutting edges 132, 134. Closure clip C together with a respective portion of plait-like portion P is cutoff from tubular casing 110 which thereby is opened.

Figure 7:
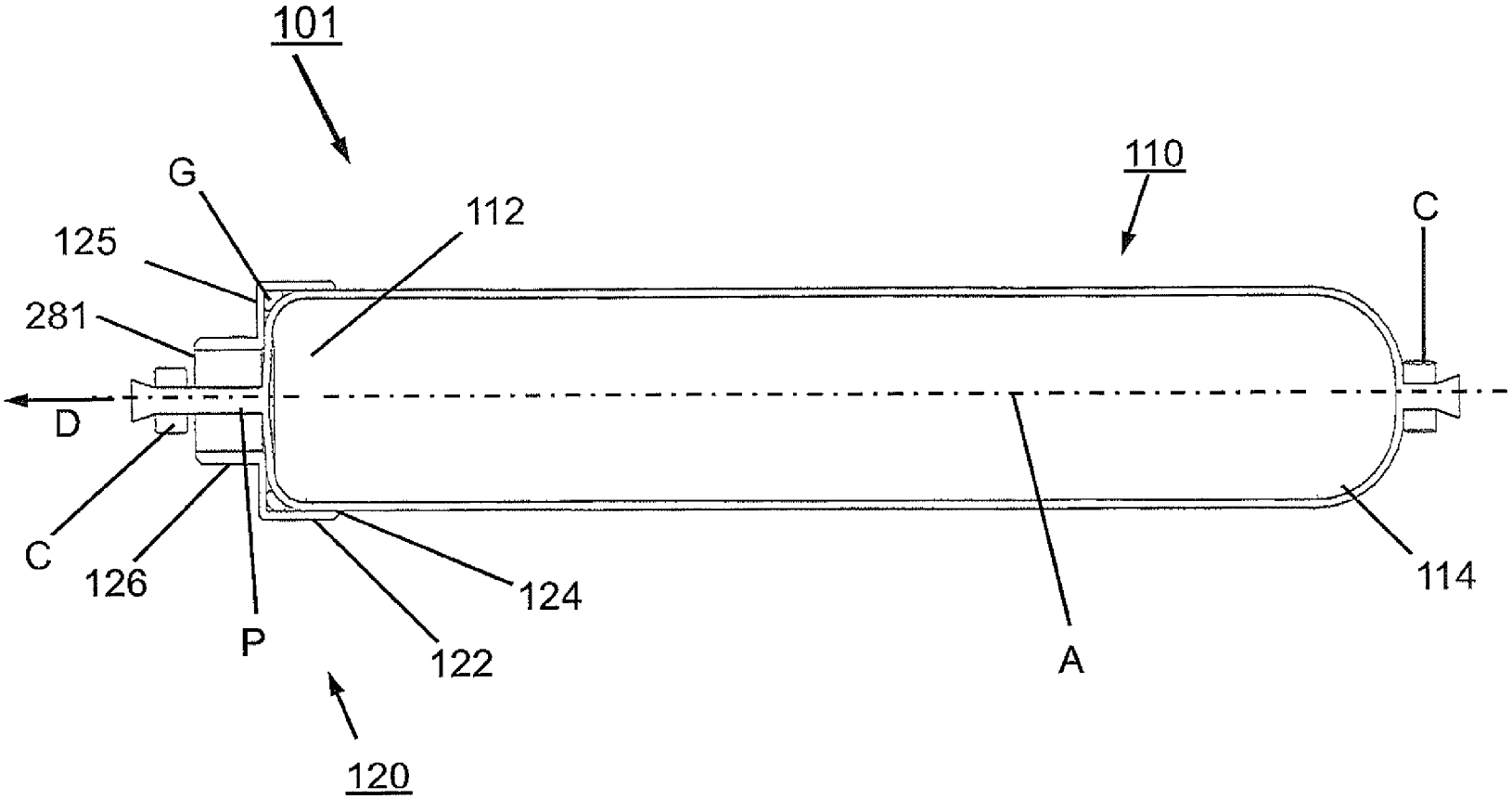
FIG. 7: is a longitudinal cross-section to the embodiment of the packaging combination of FIG. 5.

FIG. 7 shows a longitudinal-section along central axis A of the embodiment of the packaging combination 101 of FIG. 5. As it can be seen in FIG. 6, the outer diameter of tubular casing 110 corresponds to the inner diameter of the first portion 122 of dispensing device 120. Annular offset 125 and first portion 122 are approximately rectangular aligned to each other, thereby forming a flange surrounding the outer edge of first end 112 of tubular casing 110. Between inlet opening 124 and dispensing opening 128, then extends a passageway formed by the inner walls of the first and second portion 122, 126 of the dispensing device 120.

For fixedly attaching dispensing device 120 to tubular casing 110, an adhesive G, preferably a hot-melt adhesive, is disposed at the inside of the flange formed by annular offset 125 and first portion 122. The amount of adhesive G is sufficient for at least approximately filling the gap between first end 112 of tubular casing 110, annular offset 125 and first portion 122 of dispensing device 120.

Plait-like portion P at the first end 112 of tubular casing 110, which is at least approximately free from filling material and which has been formed in a known manner during filling and closing tubular casing 110, has a length that corresponds to the axial length of the second portion 126 of dispensing device 120. The length of plait-like potion P is at least equal to the axial length of the second portion 126 of dispensing device 120 in order to ensure that closure clip C closing the first end 112 of tubular casing 110 projects from outlet opening 128 of dispensing device 120 in the dispensing direction D. It has to be understood that, for attaching dispensing device 120 to first end 112 of tubular casing 110, the inner diameter of the second portion 126 of dispensing device 120, forming the dispensing opening 128, has to be at least slightly larger than the outer diameter of the closed closure clip C attached to first end 112. Accordingly, in order to open the packaging combination 101, closure clip C of first end 112 may be gripped and removed from first end 112 of tubular casing 110 and the filing material stored in tubular casing 110 may be dispensed by squeezing tubular casing 110.

Additionally, the packaging combination 101 may include a closure cap 40 as described in conjunction with the first embodiment of packaging combination 1, for closing dispensing opening 128 of dispensing device 120 and a dispensing nozzle 50 as also described in conjunction with the first embodiment of packaging combination 1, for being attached to the dispensing opening 128, in order to dispense a desired amount of filling material.

Packaging combination 101 according to the second embodiment of the present invention further comprises an indicating unit (not shown) for indicating the originality of the closure of the dispensing opening, as already described in conjunction with the first embodiment of packaging combination 1.

It has to be understood, that V-shaped cutout 130 is of a height lower than the height of the external screw thread provided at the outside of second portion 126, or at least the height of second portion 126, for attaching closure cap 40 or dispensing nozzle 50 thereto, for enabling a save sealed closing of packaging combination 101.

Moreover, the width of the upper or open end of V-shaped cutout 130 should be at least equal to the diameter of plait-like portion P for enabling a save and easy insertion of plait-like portion P into V-shaped cutout 130 for cutting off closure clip C.

The inventive opening means according to FIGS. 5 to 7 are formed by V-shaped cutout 130 having linear cutting edges 132, 134. A cutout or cutting means according to the present invention may also comprise non-linear cutting edges, e.g. curved cutting edges. In case of strong casing material, also toothed cutting edges may be provided.

The inventive opening means may also have a form different from the prescribed V-shape, e.g. the opening means may also be formed by a U-shaped or semicircular cutout, which size at least approximately corresponds to the diameter of the plait-like portion.

It has to be understood that, for partially closing closure cap 40 to dispensing device 120 without damaging plait-like portion P, the cutout has to be slightly larger than plait-like portion P.

Furthermore, more than one cutout in second portion 126 may be provided, e.g. in regular distances around dispensing opening 128.

Alternatively, the upper inner and/or outer edge of second portion, surrounding dispensing opening 128 may be sharpened or toothed for forming a cutting edge.

The plait-like portion P has been described and shown as at least approximately free from filling material. In specific cases, in particular when using a soft casing material or a fluid filling material, plait-like portion P may contain a small amount of filling material. With regard to the present invention, it is remarkable that the diameter of the plait-like portion P is smaller than the dispensing opening 28, 128 of second portion 26, 126 of dispensing device 20, 120, and that the length of plait-like portion P is sufficient to allow closure clip C closing the first end 12, 112 of tubular casing 10, 110 to project from dispensing opening 28, 128 in the dispensing direction D.

In conjunction with FIGS. 1 to 7, tubular casing 10, 110 has been described as having a circular cross section. Naturally, the casing 10, 110 containing the filling material may be of any other suitable cross-section, like a rectangular or triangular cross-section. Accordingly, also at least the first portion 22, 122 of dispensing device 20, 120 should also have a corresponding cross-section to be form-fit attached to the casing 10, 110.

For being dispensable by dispensing device 20, 120, the filling material should be of a respective consistency, e.g. pasty, fluid or granular. Accordingly any filling material being of said consistency, may be packed and dispensed by the packaging combination 1, 101 of the present invention, chemical filling materials, like silicone or grease, as well as food stuff, like sausage meat or the like.

As described above, the present packaging combination 1, 101 may be used without the need of any dispensing or pressing tools. Naturally, in particular when having a tubular casing of a circular cross section, known dispensing or pressing tools may be used to dispense the filling material from the inventive packaging combination.

Figure 8:
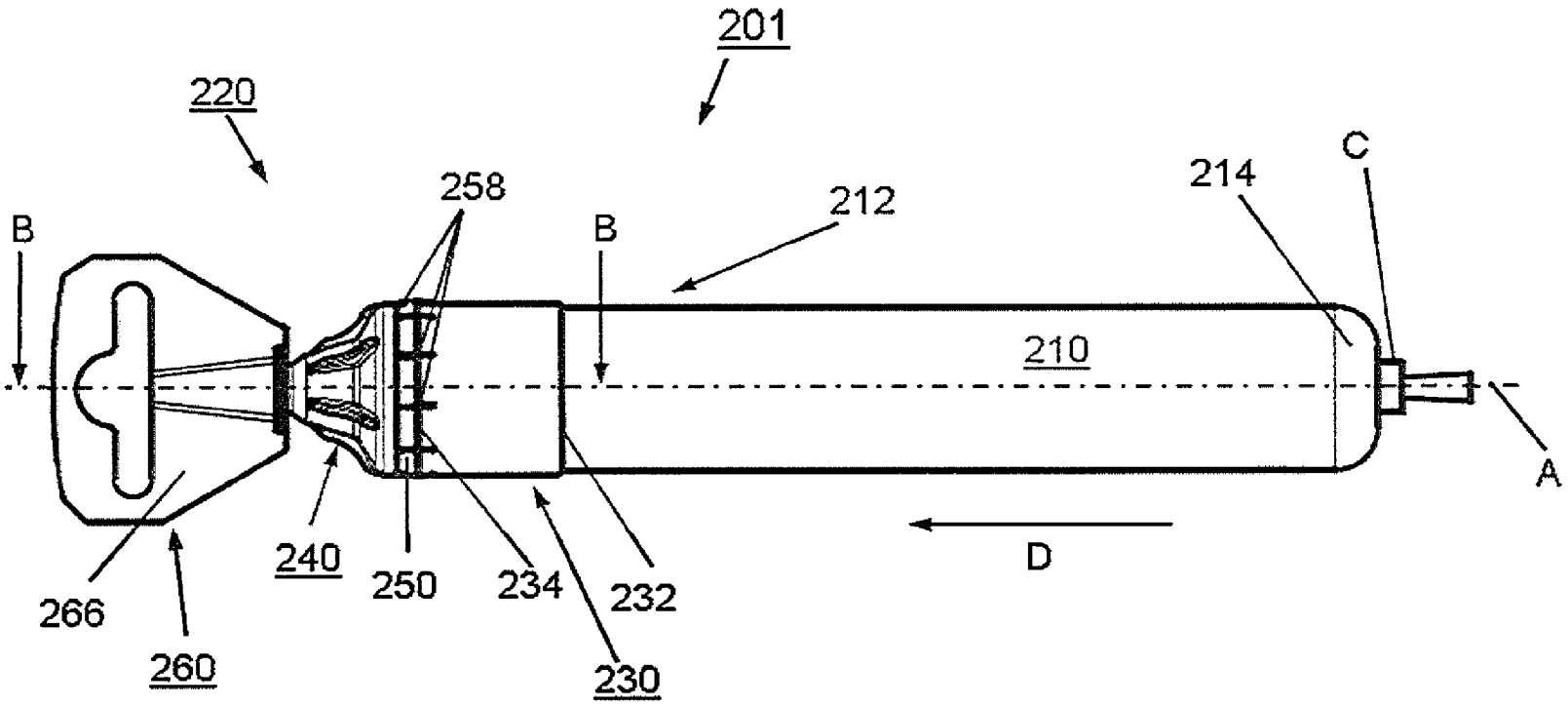
FIG. 8: is a plan view to a third embodiment of the packaging combination according to the present invention.

FIG. 8 shows a view to the third embodiment of the packaging combination 201 according to the invention. The packaging combination 201 includes a sausage-shaped tubular casing 210 having a first end 212 and a second end 214 both closed by closure clips C, and a dispensing system 220 attached to first end 212 of tubular casing 210. Tubular casing 210 has a central axis A extending through first end 212 and second end 214. Dispensing system 220 includes a dispensing device 230, a dispensing cap 240, an indicating unit 250 in the form of a tear-off strip and a closure cap 260. Dispensing device 230 has an inlet opening 232 and an outlet opening 234 between which a passage way extends through dispensing device 230 coaxially to central axis A and in a dispensing direction D.

Figure 9:
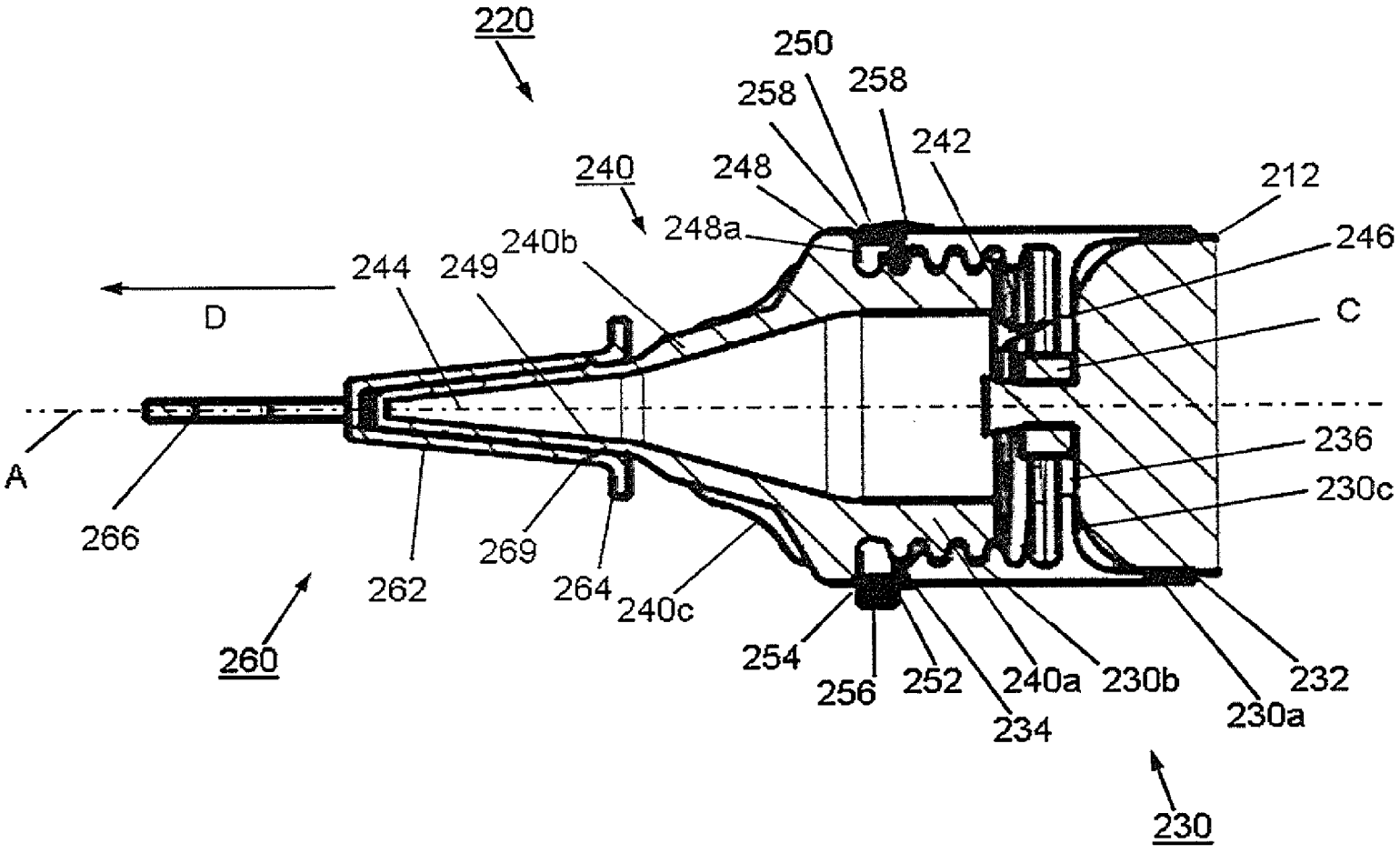
FIG. 9: is a longitudinal part section of the third embodiment of the packaging combination along line B-B shown in FIG. 8.

FIG. 9 is a longitudinal part section to the embodiment of the packaging combination 201 of FIG. 8 along line B-B, showing the first end 212 of the tightly filled tubular casing 210 closed by one closure clip C and the dispensing system 220 attached thereto.

As it can be seen in FIG. 9, dispensing device 230 according to the embodiment shown in FIGS. 8 and 9, has a substantially cylindrical shape, which is adapted to the cylindrical shape of tubular casing 210. Dispensing device 230 has a first portion 230*a* including an inlet opening 232 and a second portion 230*b* including an outlet opening 234. Between portions 230*a* and 230*b* of dispensing device 230, a circumferential flange 230*c* extends from the inner surface of the dispensing device 230 towards central axis A, having a central hole 236 which is part of the passage way through dispensing device 230. Flange 230*c* forms an abutment for tubular casing 210 when inserted into dispensing device 230.

As it can be seen in FIG. 9, tubular casing 210 abuts shoulder formed by the transition portion between the main portion of tubular casing 210 and the plait-like end closed by closure clip C against the surface of flange 230*c* facing in the direction towards inlet opening 232. The plait-like end of tubular casing 210 closed by closure clip C extends through central hole 236 into the inner part of portion 230*b* of dispensing device 230.

At inner surface of first portion 230*a* and/or at the surface of flange 230*c*, facing tubular casing 210, an adhesive, like a hot-melt adhesive or the like, may be provided for securing dispensing device 230 to tubular casing 210. The diameter of central hole 236 is larger than the outer diameter of the closure clip C at first end 212 of tubular casing 210, for allowing closure clip C to be guided through central hole 236. The inner surface of first portion 230*a* has a cylindrical shape with an inner diameter which corresponds to the outer diameter of tubular casing 210. At the inner surface of second portion 230*b*, an inner screw thread is applied, extending between flange 230*c* and outlet opening 234.

As shown in FIG. 9, dispensing cap 240 has an approximately cylindrical portion 240*a* and an approximately conical portion 240*b* attached to the cylindrical portion 240*a* by its larger diameter end or base end. Cylindrical portion 240*a* has a cylindrical through hole, and conical portion has a conical through hole. The inner diameter of first portion 240*a* corresponds to the inner diameter of the base end of conical portion 240*b*. The free end of cylindrical portion 240*a* of dispensing cap 240 facing tubular casing 210, forms an inlet end or attachment end 242, whereas the free end of the conical portion facing in dispensing direction D, forms a dispensing end 244.

At the outer surface of cylindrical portion 240*a* of dispensing cap 240, an outer screw thread is provided, matching the inner screw thread of second portion 230*b* of dispensing device 230. The outer screw thread at cylindrical portion 240*a* extends from attachment end 242 towards the junction between cylindrical portion 240*a* and conical portion 240*b*. Its axial length at least approximately corresponds to the axial length of the inner screw thread of second portion 30*b*.

Screw thread shown in FIG. 9, is a round threads. Naturally, any other suitable kind of thread may be used, like trapezoid thread or metric thread.

The surface of attachment end 242, facing flange 230*c* of dispensing device 230, has an annular shape. A cutting element in the form of a spike 246 is provided at said annular surface, extending towards first end 212 of tubular casing 210. Spike 246 has an approximately triangular shape, and is attached to attachment end 242 by its base, and terminates in a sharpened tip end. As it can be seen in FIG. 9, spike 246 is positioned at a radial distance from central axis A, which is smaller than the radius of hole 236 of flange 230*c*. This allows spike 246 to engage hole 236, and thus, also to engage and to open first end 212 of tubular casing 210, when dispensing cap 240 is screwed in into second portion 230*b* of dispensing device 220.

In the originally closed condition of packaging combination 1 as shown in FIG. 9, dispensing cap 240 is not fully screwed in into second portion 230*b* of dispensing device 230. Thus, tip end of cutting element 46 does not engage central hole 236, and also may not engage first end 212 of tubular casing 210.

Moreover, on the outer surface of dispensing cap 240, in particular, at the junction between cylindrical portion 240*a* and conical portion 240*b*, a circumferentially extending protrusion or rim 248 is provided. Protrusion or rim 248 has an outer diameter which is at least equal to the outer diameter of dispensing device 230, thereby an annular surface 248*a* is formed facing outlet opening 234 of dispensing device 230.

As it can be seen in FIG. 9, dispensing cap 240 is not completely screwed into second portion 230*b* of dispensing device 230. Thereby, a gap is provided between annular surface 248*a* of rim 248 of dispensing cap 240 and outlet opening 234 of dispensing device 230. In said gap, an indicating unit in the form of a tear-off strip 250 is arranged, for indicating the originality of the closure of the packaging combination 201, in particular the originality of the closure of the dispensing opening of the dispensing system 220. When attached to dispensing system 230, tear-off strip 250, at least approximately, has the shape of a hollow cylinder, with a first end 252 directed towards dispensing device 230 and a second end 254 directed towards annular surface 248*a* of rim 248. Tear-off strip 250 further comprises a handle 256 for enhancing pulling off tear-off strip 250 from dispensing system 220.

Indicating unit or tear-off strip 250 surrounds the end of the outer screw thread of cylindrical portion 240*a* of dispensing cap 240. The at least approximately cylindrical outer shape has a diameter corresponding to the outer diameter of dispensing device 230 or rim 248. Handle 256 extends from the outer shape of tear-off strip 250.

As it can be seen in FIG. 8, tear-off strip 250 is attached by its first end 252 to outlet opening 234 of dispensing device 230 by welded spots 258 (see FIG. 8) arranged in regular intervals around outlet opening 234. Furthermore, the second end 254 of tear-off strip 250 is attached to rim 248 of dispensing cap 240 by respective welded spots 258. The axial length of tear-off strip 250, namely the distance between its first and second end 252, 254, corresponds to the axial length of spike 246, to ensure that spike 46 does not comes in contact with first end 212 of tubular casing 210, when dispensing system 230 is originally closed.

Closure cap 260 is attached to dispensing end 244 of conical portion 240*b*. Closure cap 260 includes a conical member 262, a flange member 264 surrounding the largest diameter end or base end of conical member 262, and radially extending therefrom. Conical member 262 has an axial length shorter than the axial length of conical portion 240*b* of dispensing cap 240. The axial length of conical member 262, according to FIG. 9, is approximately the half of the length of conical portion 240*b*. The inner shape of conical member 262 corresponds to the outer shape of the section of conical portion 240*b*, which is covered by conical member 262. This section of conical portion 240*b* has an approximately constant wall thickness, whereas the section of conical portion 240*b*, which is not covered by closure cap 260, has a larger and non constant wall thickness and, additionally comprises ribs 240*c* arranged in regular intervals at its outside. Ribs 240*c* are axially aligned and extend radially from conical portion 240*b*.

Closure cap 260 further comprises a flat fin member 266 (see FIG. 1) arranged in a plane extending through longitudinal axis A of tubular casing 210, when being attached to dispensing device 230. Fin member 266 includes an opening arranged above conical member 262 in the dispensing direction D, for forming a hanger by which packaging combination 201 may be hung up, e.g. for presentation or the like.

For securing closure cap 260 to dispensing cap 240, a circumferential extending groove 269 is arranged at the inner surface of closure cap 260. At the outer surface of conical portion 240*b*, a corresponding circumferentially extending notch 249 is provided for engaging groove 269 of closure cap 260 when attached to dispensing cap 240.

Figure 10:
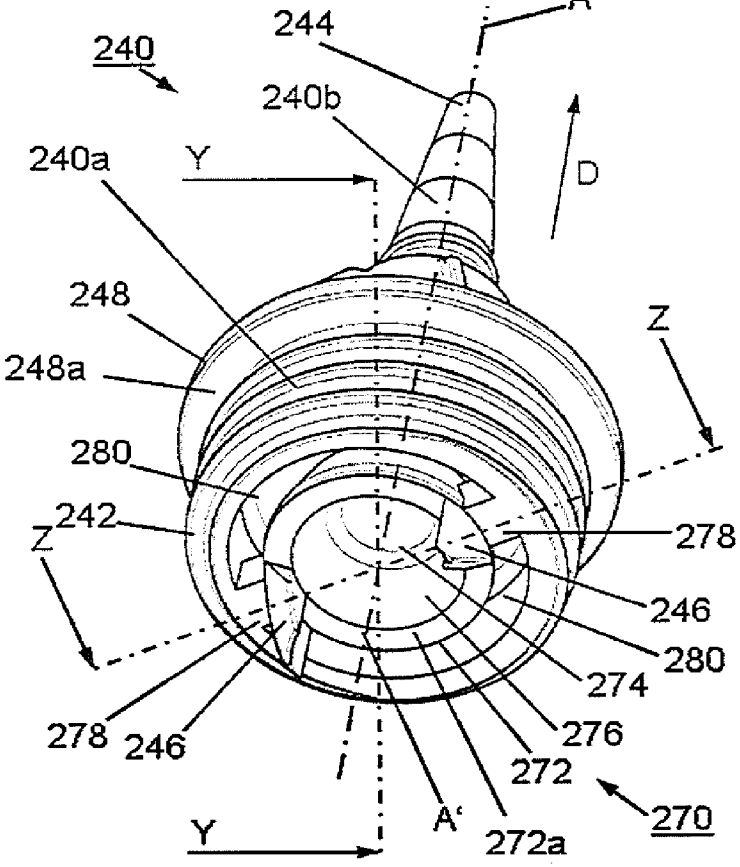
FIG. 10: is a perspective view to a dispensing cap according to an alternative configuration of the third embodiment of the packaging combination of to the present invention.

FIG. 10 is a perspective view to a dispensing cap 240 according to an alternative configuration of the third embodiment of the packaging combination 201 of to the present invention. Similar to the first configuration of the third embodiment of the inventive packaging combination 201 including the dispensing system 220, dispensing cap 240 according to the first configuration of the third embodiment of packaging combination 201 also has an approximately cylindrical portion 240*a* an approximately conical portion 240*b*, with an inlet end or attachment end 242 and a dispensing end 244, respectively.

As it can be seen in FIG. 10, dispensing cap 240 of packaging combination 201 comprises a cap member 270. Cap member 270 has an opened end 272 and a closed end 274, which are coupled by a conically shaped circular wall 276. Cap member 270 further has a central axis A', which extends centrally through opened and closed ends 272, 274. Central axis A' of cap member 270, according to the embodiment shown in FIGS. 10 to 12, coincides with central axis A of tubular casing 210. The closed end 274 of cap member 270 is formed by a flat element, but may also be formed by an element of any suitable form, like a spherical, partially spherical or pyramidal element terminating in a tip end. Opened end 272 of cap member 270 has an annular shape and terminates in an annular surface 272*a* which faces towards tubular casing 210, when attached to dispensing device 230. Annular surface 272*a* of cap member 272 is arranged in a plane defined by the annular surface of attachment end 242 of dispensing cap 240.

Cap member 270 is fixed to dispensing cap 240 by two bars 278 extending between the outer surface of cap member 270 and the inner surface of cylindrical portion 240*a* of cap member 240. Bars 278 have an approximately rectangular cross-section and extend in a plane parallel to annular surface 272*a* of cap member 272. Two approximately semi-circular slots 280 are formed between the outer surface of cap member 70 and the inner surface of cylindrical portion 240*a* of cap member 240.

As it further can be seen in FIG. 10, in the second configuration of the dispensing cap 240, two cutting elements 246 are attached to annular surface 272*a* of cap member 270, in the region of the conjunction of cap member 270 and bars 278, whereby slots 280 extending between bars 278, and thus, the passage way for the filling material when being squeezed out of packaging combination 201, are not blocked by cutting elements 246.

Figure 11:
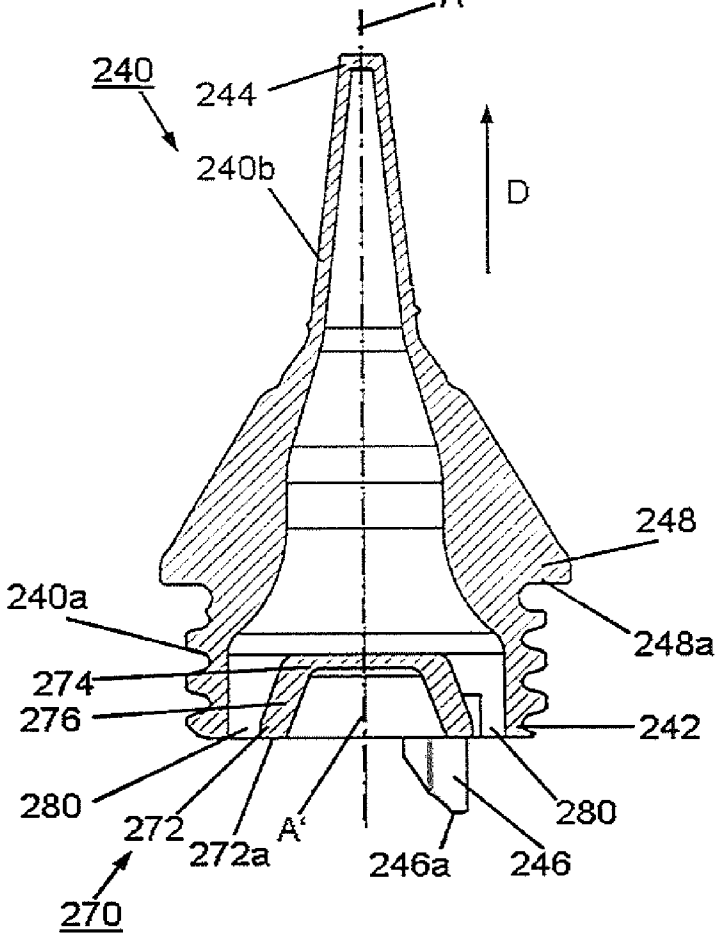
FIG. 11: is a longitudinal part section of the dispensing cap along line Y-Y through the central axis, shown in FIG. 10.

FIG. 11 is a longitudinal part section of dispensing cap 240 along line Y-Y shown in FIG. 10. Cap member 270 is centrally arranged in dispensing cap 240, in the region of attachment end 242, with central axis A' coinciding with central axis A. Cap member 270 is arranged in dispensing cap 240 in a manner that annular surface 272*a* of opened end 272 lies in the same plane as the annular surface of attachment end 242 of dispensing cap 240, and concentrically thereto. Between the outer surface of cap member 270 and the inner surface of cylindrical portion 240*a* of cap member 240, slots 280 are formed, providing a passage way for the filling material along cap member 270. Wall 276 of cap member 270 has a conical shape. Accordingly, the cross-section of slots 280 expands in filling D.

Cutting elements 246 (in FIG. 11, only one of them is visible), comprise a body attached to cap member 270 by one end, and a cutting edge 246*a* at the other end, facing away from cap member 270.

Figure 12:
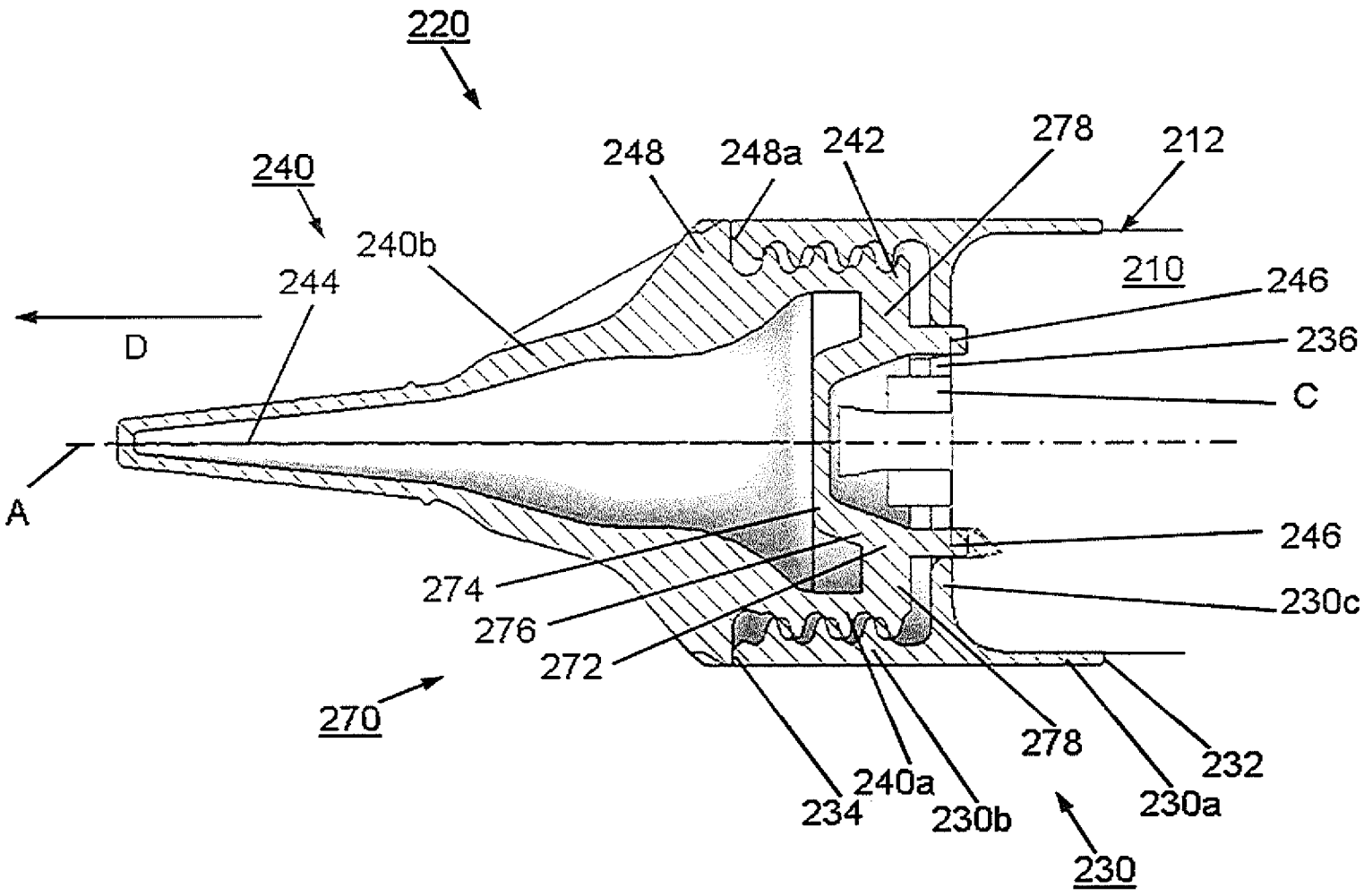
FIG. 12: is a longitudinal part section of the embodiment of the packaging combination along line Z-Z through the central axis, shown in FIG. 10.

FIG. 12 is a longitudinal part section of the second configuration of packaging combination 201 along line Z-Z shown in FIG. 10, in a situation, in which indicating unit 250 has been removed, and dispensing cap 240 having an outer screw thread, is completely crewed in into the internal screw thread of dispensing device 230. As it further can be seen, when dispensing cap 240 is completely screwed in into dispensing device 230, annular surface 248*a* of rim 248 of dispensing cap 240 abuts outlet opening 234 of dispensing device 230. Cutting elements or spikes 246 extending through central hole 236 of dispensing device 230, and penetrating the casing material surrounding clip C.

As it can further be seen in FIG. 12, an approximately annular space is left between the annular surface of attachment end 242 of dispensing cap 240 and the surface of flange 230*c* of dispensing device 230 facing towards dispensing cap 240. This annular shaped space is part of the passage way for the filling material when being squeezed out of packaging combination 201.

As shown in FIG. 12, cap member 270 accommodates the plait-like portion of first end 212 of tubular casing 210 together with clip C attached thereto. In particular, cap 270 accommodates the complete portion cut off from first end 212 by cutting elements 246, which includes clip C, the plat-like portion and the casing material remaining at said plait-like portion, which is thereby prevented from being shifted towards outlet end 244 of dispensing cap 240.

Moreover, in order to provide a passage way of sufficient size, the wall thickness of cylindrical portion 240*a* of cap member 240 according to the second configuration of packaging combination 201 shown in FIGS. 10 to 12, is smaller than the wall thickness of cylindrical portion 240*a* of cap member 240 of the first configuration according to FIGS. 8 and 9, at least in the region of cap member 270.

Depending on the size of tubular casing 210 and, accordingly to the size of the plait-like portion and clip C closing said plait-like portion as well as the shape of dispensing cap 240, cap member 260 may have a shape different from the that shown in FIG. 8 or 9.

For opening packaging combination 201 and dispensing the filling material contained in tubular casing 210, handle 256 of indicating unit or tear-off strip 250 is grabbed and pulled-off from dispensing system 220 in a radially direction, by breaking open welded spots 258. After tear-off strip 250 is removed, the gap between annular surface 248*a* of rim 248 of dispensing cap 240 and outlet opening 234 of dispensing device 230 is released. Thereafter, dispensing cap 240 may finally be screwed in into second portion 230*b* of dispensing device 230, according to height of the gap which corresponds to e.g. one revolution of the screw thread of dispensing cap 240, until annular surface 248*a* of rim 248 abuts outlet opening 234 of dispensing device 230.

While screwing in dispensing cap 240 into dispensing device 230, spike 246 extending from attachment end 242 towards tubular casing 210, is moved through hole 236 of flange 230*c* and in axial direction towards first end 212 of tubular casing 210. Due to the fact that dispensing cap 240 is screwed in into dispensing device 230, spike 236 also executes a circular movement about central axis A.

Spike 269, while moving towards first end 212 of tubular casing 210, penetrates the casing material and, due to its circular movement, partially ruptures the casing material around closure clip C. The partially cut off plait-like portion together with clip C is halt at first end 212 of tubular casing 210 by the remaining casing material being not cut off.

According to the second configuration of packaging combination 201, cap member 270 is arranged above closure clip C of first end 212. After the casing material has been partially ruptures around closure clip C, the plait-like portion together with closure clip C pivoting away from first end 212 about the remaining casing material being not cut off, is accommodated by cap member 270, which prevents closure clip C and the plait-like portion from being shifted towards and blocking of dispensing end 244 of dispensing cap 240.

Since, according to said second configuration of packaging combination 201, two cutting elements or spikes 246 are provided, and due to its circular movement, the casing material around closure clip C may not only be partially ruptured. The plait-like portion together with closure clip C may completely be cut off. Cap member 270 accommodates and keeps the cut off plait-like portion together with closure clip C.

According to the radial distance of cutting elements 246 from central axis A', the circular portion of the casing material being cut off together with the plait-like portion has a size which, completely or at least partially, may cover closure clip C when accommodate in cap member 270. Thereby the filling material, when passing cap member 270 and closure clip C while being squeezed out, is prevented from contacting closure clip C and/ or the outer surface of the casing material. Thereby a possible contamination of the filling material during dispensing is prevented.

It has to be noted that the length of spike 246, the axial length of tear-off strip 250 as well as the screw in depth of dispensing cap 240 have to be chosen such, that closure clip C is not fully cut off from first end 212 of tubular casing 210, to avoid closure clip C from blocking the passage way for the filling material through dispensing cap 240.

After tubular casing 210 is ruptured by spike 246, the filling material may be dispensed just by squeezing the filled tubular casing 210.

The packaging combination 201, in particular dispensing end 244 of dispensing cap 240, may be closed by closure cap 260 which may be attached to dispensing cap 240 and secured thereon by notch 249 of conical portion 240*b*, which engages groove 269 of closure cap 260.

According to the second configuration of packaging combination 201, cap member 270 is fixed to dispensing cap 240 by two bars 280, and comprises two cutting elements or spikes 246. It has to be understood, that cap member 270 may be fixed to dispensing cap 240 by only one bar or by more than two bars, like by four bars which e.g. may be regularly arranged around the cap member in angles of 90°. Also, only one or more than one cutting element or spike may be provided. The number of cutting elements may correspond to the number of bars fixing the cap member. Accordingly, the cutting elements should be arranged at the respective conjunction between the bars and the cap member, in order to leave the most possible space for the passage way for the filling material.

Cap member 270 has been described as being arranged concentrically in dispensing cap 240, forming approximately semi-circular slots 280 between cap member 270 and the inner surface of dispensing cap 240. Naturally, the cap member may not necessarily be arranged centrally in the dispensing cap. The cap member may also be eccentrically arranged, e.g. directly attached to the inner surface of the dispensing cap. Essentially in the sense of the present invention is that the cap member covers or accommodates the plait-like portion together with the closure clip at least when being partially or completely cut off from the first end of the tubular casing.

It has to be understood that, before dispensing filling material, closure cap 260 has to be removed from dispensing cap 240 to uncover dispensing end 244 of conical portion 240*b*. Dispensing end 240 may be closed by a membrane or the like. Thus it may be necessary to remove said membrane. Moreover, depending on the kind of filling material and the amount of filling material to be dispensed, the section of conical portion 240*b* covered by closure cap 260, may partially be cut off according to the desired size of the opening at dispensing end 244.

According to the first and second configuration of the inventive packaging combination 201, dispensing cap 240 has been attached to dispensing device 230 by means of outer and inner screw threads. Other attachment means may be used, like a bayonet connector. In this case, cylindrical portion 420*a* of dispensing cap 240 may be provided wits pins radially extending, and second portion 230*b* of dispensing device 230 may comprise appropriate slots which may be engaged by said pins.

Closure cap 260 has been described as being secured to conical portion 240*b* of dispensing cap 240 by notch 249 of conical portion 240*b*, which engages groove 269 of closure cap 260. Alternatively, conical portion 240*b* may comprise an outer screw thread, and conical member 262 of closure cap 260 may be provided with an inner screw thread matching said outer screw thread.

Moreover, spike 246 has a sharpened tip end. In order to achieve a controlled opening of the first end of the tubular casing, spike 246 may have the form of a blade, including a sharpened cutting edge. Additionally, more than one cutting element may be provided, which then preferably may be arranged in regular intervals at attachment end 242 of closure cap 240.

In conjunction with FIGS. 8 to 12, tubular casing 210 has been described as having a circular cross section. Naturally, the casing 210 containing the filling material may be of any other suitable cross-section, like a rectangular or triangular cross-section. Accordingly, also at least the first portion 230*a* of dispensing device 230 should also have a corresponding cross-section to be form-fit attached to the casing 210.

Dispensing device 230 and dispensing cap 240 have been described as comprising first and second portions or cylindrical and conical portions, respectively. It has to be understood, that each of dispensing device 230 or dispensing cap 240 is an integrally formed part which is not composed of single first and second portions. Moreover, dispensing system 220 in its originally closed condition, including dispensing device 230, closure cap 240 and indicating unit 250, may also be integrally formed, e.g in a laser sintering operation.

Even if not shown, also dispensing cap 240 according to FIGS. 10 to 12 may also be provided with a closure cap 260 for closing the dispensing opening of dispensing end 244.

The material used for the dispensing system, like a suitable plastic or metal, may be selected depending on the production method for the dispensing system or the filling material to be dispensed.

For being dispensable by dispensing device 220, the filling material should be of a respective consistency, e.g. pasty, fluid or granular. Accordingly any filling material being of said consistency, may be packed and dispensed by the packaging combination 201 of the present invention, chemical filling materials, like silicone or grease, as well as food stuff, like sausage meat or the like.

Tubular casing 210 according to FIGS. 9 to 12 is shown as being tightly filled, without having a plait-like portion at its first end, as shown in conjunction with the first and second embodiment of the present invention in FIGS. 1 to 7. It has to be understood that dispensing device 220 according to the third embodiment of the present invention may also be attached to a tubular casing 10, 110 according to the first and second embodiment of the present invention, having a plait-like portion which is at least approximately free from filling material.

As described above, the present packaging combination 201 may be used without the need of any dispensing or pressing tools. Naturally, in particular when having a tubular casing of a circular cross section, known dispensing or pressing tools may be used to dispense the filling material from the inventive packaging combination.

The invention claimed is:

1. A packaging combination for accommodating and dispensing a viscous or granular filling material, the packaging combination comprises a tubular casing having a first end and a second end, wherein the tubular casing is partially filled with filling material and closed at its first as well as its second end by a closure means, wherein the partially filled tubular casing comprises a plait-like portion at its first end being at least approximately free of filling material, the packaging combination further comprises a dispensing device having a passageway extending through the dispensing device with an inlet opening at its one end and a dispensing opening at its other end for guiding and dispensing the filling material in a dispensing direction, and being attached to the first end of the partially filled and closed tubular casing, wherein the plait-like portion of the tubular casing extends through the passageway and beyond the dispensing opening of the dispensing device such that the closure means closing said first end is arranged outside the dispensing opening, and wherein at least the dispensing device comprises at least an element of one opening means for opening the tubular casing.

2. The packaging combination according to claim 1, wherein the at least one opening means are entirely provided at the dispensing device.

3. The packaging combination according to claim 2, wherein the opening means are formed by a V-shaped cutout in the dispensing device.

4. The packaging combination according to claim 1, wherein the opening means include at least one cutting element.

5. The packaging combination according to claim 4, wherein the at least one cutting element is arranged in the region of the opened end of the cap member attachment to the first end of the tightly filled tubular casing, wherein the first end of the tubular casing extends inside the passageway of the dispensing device, wherein the dispensing device comprises at least an element of one opening means for opening the tubular casing.

6. The packaging combination according to claim 1, wherein the opening means is a cutout in the dispensing device and includes at least one cutting element being provided within the cutout and projecting into the clearance of the cutout.

7. The packaging combination according to claim 1, further comprising a closure cap reversibly attachable to the dispensing device for releasing and closing the dispensing opening.

8. The packaging combination according to claim 7, wherein at least one element of the opening means is provided at the dispensing device and at least another element of the opening means is provided at the closure cap.

9. The packaging combination according to claim 8, wherein the at least one element of the opening means provided at the dispensing device is adapted to hold the first end of the tubular casing such that the closure means are placed outside the dispensing device and that the at least one element of the opening means provided at the closure cap is adapted to cutoff the first end of the tubular casing together with the closure means.

10. The packaging combination according to claim 9, wherein the closure cap is provided with abutment means and wherein the at least one element of the opening means provided at the closure cap is arranged, directed in the abutment direction of the closure cap to the dispensing device, behind the abutment means.

11. The packaging combination according to claim 10, wherein the abutment means are adapted to be broken with the first opening of the packaging combination.

12. The packaging combination according to claim 11, wherein, for the first closing of the packaging combination, the closure cap is adapted to be closed on the dispensing device until reaching the abutment means and that, for the first opening of the packaging combination, the closure cap is adapted to be moved further in the abutment direction for breaking the abutment means and for bringing in engagement the at least one element of the opening means provided at the dispensing device, with the first end of the tubular casing provided at the at least one element of the opening means arranged at the dispensing device for cutting off the first end of the tubular casing together with the closure means.

13. The packaging combination according to claim 1, wherein an indicating unit for indicating the originality of closure of the dispensing opening is provided at the dispensing device.

14. The packaging combination according to claim 1, further comprising a dispensing nozzle having an internal screw thread for being reversibly attachable to the external screw thread of the dispensing device.

15. A dispensing device for being attached to a tubular casing being partially filled with filling material to form a packaging combination, the dispensing device comprising:

a passageway extending through the dispensing device with an inlet opening at its one end and an outlet opening at its other end for guiding and dispensing the filling material in a dispensing direction, and being configured for attachment to the first end of the tightly filled tubular casing, wherein the first end of the tubular casing extends inside the passageway of the dispensing device, wherein the dispending device comprises at least an element of one opening means for opening the tubular casing.

16. The dispensing device of claim 15, the dispensing device forming a component of a dispensing system, the dispensing system further including a dispensing cap and an indicating unit, for being attached to a tightly filled tubular casing to form a packaging combination including:

a tubular casing having a first end, a second end and a central axis extending through the first and second ends, wherein the tubular casing is tightly filled with filling material and closed at its first and second end by a closure means, like a closure clip;

wherein the dispensing system further comprises a dispensing cap having an attachment end and a dispensing end, which is reversibly attachable to the outlet opening of the dispensing device, by its attachment end, wherein the dispensing cap further comprises a cap member having a central axis, an opened end and a closed end, arranged at the attachment end of the dispensing cap and coaxially aligned to central axis, with its opened end directed towards the tubular casing.

17. A packaging combination for accommodating and dispensing a viscous or granular filling material, the packaging combination comprises:

a tubular casing having a first end, a second end and a central axis extending through the first and second ends, wherein the tubular casing is tightly filled with filling material and closed at its first and second end by a closure means; and a dispensing system including a dispensing device having a passageway extending through the dispensing device with an inlet opening at its one end and an outlet opening at its other end for guiding and dispensing the filling material in a dispensing direction, and being attached to the first end of the tightly filled tubular casing, wherein the first end of the tubular casing extending inside the passageway of the dispensing device; and wherein the dispensing system further comprises a dispensing cap having an attachment end and a dispensing end, which is reversibly attachable to the outlet opening of the dispensing device, by its attachment end, wherein the dispensing cap further comprises a cap member having a central axis, an opened end and a closed end, arranged at the attachment end of the dispensing cap and coaxially aligned to central axis, with its opened end directed towards the tubular casing.

18. The packaging combination according to claim 17, wherein the dispensing cap comprises at least one cutting element for opening the tubular casing at its first end.

19. The packaging combination according to claim 18, wherein the at least one cutting element extends from the attachment end of the dispensing cap in a direction opposite to the dispensing direction.

20. The packaging combination according to claim 17, wherein an indicating unit for indicating the originality of closure of the dispensing system is provided at the dispensing system.

21. The packaging combination according to claim 20, wherein, in the originally closed condition of the packaging combination, the indicating unit is adapted to fix the dispensing cap in a predefined position relative to the dispensing device.

22. The packaging combination according to claim 17, wherein the dispensing device includes at least a first portion and a second portion, wherein the first portion extends from the inlet opening of the passageway in the dispensing direction and the second portion extends from the outlet opening opposite to the dispensing direction, and wherein the inner circumferential dimensions of the first portion corresponds at least approximately to the outer circumferential dimensions of the tubular casing.

23. The packaging combination according to claim 22, wherein a circumferential flange extends at the inner surface of the dispensing device in a region between the first portion and the second portion.

24. The packaging combination according to claim 17, wherein an internal screw thread is provides at the outlet opening of the dispensing device, and wherein a corresponding external screw thread is provided at the attachment end of the dispensing cap for being attached to the outlet opening of the dispensing device.

25. The packaging combination according to claim 24, wherein the dispensing cap comprises a protrusion extending at its outside in the region of the end of the external screw tread directed towards the dispensing end.

26. The packaging combination according to claim 25, wherein the indicating unit is a tear-off strip provided between the outlet opening of the dispensing device and the protrusion extending from the dispensing cap.

27. The packaging combination according to claim 26, wherein the protrusion extending from the dispensing cap is an annular protrusion surrounding the dispensing cap, and the indicating unit is a tear-off strip surrounding the dispensing cap between the outlet opening of the dispensing device and the annular protrusion.

28. The packaging combination according to claim 17, wherein a closure cap is provided reversibly attachable to the dispensing cap.

* * * * *